US007478999B2

(12) United States Patent
Limoges

(10) Patent No.: US 7,478,999 B2
(45) Date of Patent: Jan. 20, 2009

(54) PERISTALTIC PUMP

(75) Inventor: Robert F. Limoges, Highland Park, IL (US)

(73) Assignee: Cole-Parmer Instrument Company, Vernon Hills, IL (US)

( * ) Notice: Subject to any disclaimer, the term of this patent is extended or adjusted under 35 U.S.C. 154(b) by 362 days.

(21) Appl. No.: 11/070,989

(22) Filed: Mar. 3, 2005

(65) Prior Publication Data

US 2005/0196307 A1 Sep. 8, 2005

Related U.S. Application Data

(60) Provisional application No. 60/549,532, filed on Mar. 4, 2004.

(51) Int. Cl.
*F04B 43/08* (2006.01)
*F04B 43/12* (2006.01)

(52) U.S. Cl. ..... 417/474; 417/475; 417/477

(58) Field of Classification Search ..... 417/474–477
See application file for complete search history.

(56) References Cited

U.S. PATENT DOCUMENTS

| | | | | |
|---|---|---|---|---|
| 4,138,205 | A | 2/1979 | Wallach | 417/360 |
| 4,558,996 | A | 12/1985 | Becker | 417/374 |
| 4,631,008 | A | 12/1986 | Stenner | 417/477 |
| 4,813,855 | A | 3/1989 | Leveen et al. | |
| 4,925,376 | A | 5/1990 | Kahler | |
| 4,976,590 | A | 12/1990 | Baldwin | 417/53 |
| 5,082,429 | A | 1/1992 | Soderquist et al. | |
| 5,388,972 | A | 2/1995 | Calhoun et al. | 417/477.11 |
| 5,433,588 | A | 7/1995 | Monk et al. | 417/477.2 |
| 6,019,582 | A | 2/2000 | Green | |
| 6,494,692 | B1 | 12/2002 | Green | |

FOREIGN PATENT DOCUMENTS

| | | | |
|---|---|---|---|
| EP | 0 019 205 | A1 | 11/1980 |
| EP | 0 731 275 | A1 | 9/1996 |
| EP | 0 825 345 | A2 | 2/1998 |
| EP | 0834653 | A2 | 4/1998 |
| EP | 1048848 | A1 | 11/2000 |
| EP | 1 291 027 | A1 | 3/2003 |

*Primary Examiner*—Devon Kramer
*Assistant Examiner*—Patrick Hamo
(74) *Attorney, Agent, or Firm*—Wood, Herron & Evans, L.L.P.

(57) ABSTRACT

A peristaltic pump for pumping fluids through a flexible tube has a pump body, a support structure, a tube retaining mechanism and a linkage mechanism. Locating features make sure that the support structure is at a fixed location with respect to the pump body when the pump is in the closed position. The support structure controls movement of the retaining mechanism. The linkage mechanism applies the necessary force to move the support structure so that the pump is moved from an open position to a closed position.

34 Claims, 18 Drawing Sheets

PERISTALTIC PUMP

CROSS REFERENCE TO RELATED APPLICATION

This application claims priority to provisional application U.S. Ser. No. 60/549,532, filed on Mar. 4, 2004 and is included herein in its entirety.

The present invention relates to a peristaltic pump. More particularly, it relates to a peristaltic pump that automatically positions the various components to facilitate tube placement, promote optimal pump operation and extend tube life.

BACKGROUND OF THE INVENTION

Rotary peristaltic pumps are usually used for moving liquids through flexible tubing. A typical pump has a rotor assembly with a shaft, two plates, and several rollers. The plates are fixed to the shaft, perpendicular to the axis of the shaft. The rollers are secured, by means of respective axles, between the two plates. The rollers, being nearly identical in diameter, are situated at essentially the same radial distance from and equally spaced angularly about the rotor shaft axis. In turn, the shaft is connected to a motor that applies a rotational force to the shaft. Thus, when power is applied to the motor; the shaft rotates, causing the rollers to describe an orbital path. An occlusion bed has a larger radius than the orbital path of the rollers, and is positioned so that the axis of the occlusion bed surface is coincident with the axis of the rotor assembly. Flexible hollow tubing is positioned between the occlusion bed and the rollers. When the rotor is turned, pressure applied by each roller to the tubing provides a squeezing action between the roller and the occlusion bed, creating increased pressure ahead of the squeezed area and reduced pressure behind that area, thereby forcing a liquid through the tubing.

The spacing between the occlusion bed and the rotor assembly is critical for proper pump operation, and known prior art pumps have a number of disadvantages that limit the ability to provide consistent spacing. For example, the linkage used to open and close the occlusion bed with respect to the pump body is very complicated, requiring numerous components to create the linkage. Moreover, the tolerances of each of the components results in additional complications. However, the spacing between an occlusion bed and a rotor assembly is unforgiving from a tolerance standpoint since it is used both to provide a compressive force between the rotor assembly and occlusion bed pump and to locate the occlusion bed with respect to the rotor assembly.

Further, installation of the tube is complicated in known pumps. For instance, jaws that grip the tube must be manually separated with select tube diameters not automatically fully opened such that the tube can be removed without touching the jaws when the peristaltic pump is opened. Moreover, it is desirable to be able to stretch the installed tube to prolong its useful life. Known peristaltic pumps lack the ability to provide a constant stretching independent of tube size. In addition, pumps are typically preferred that have tube entry and exit on the same side of the pump, to minimize the possibility of interfering with other equipment.

Thus, a pump is desired that provides at least one or more of the following advantages: very accurate positioning of the occlusion bed with respect to the rotor assembly to properly occlude the tubing; retaining automatically a wide range of tubing; is simple to operate; provides consistent tube tensioning independent of the type of tube used; and is installed from a single side or single end of the pump.

BRIEF SUMMARY OF THE INVENTION

A peristaltic pump is disclosed that is movable between an open position and a closed position. The pump has a pump body and a support structure. The support structure and the pump body are in facing relationship with each other. An arcuate working surface extends from a front face of the support structure.

At least one of the pump body and the support structure include locating features so that the support structure is at a fixed location with respect to the pump body when the pump is in the closed position. As the support structure moves with respect to the pump body, the pump moves between the open position and the closed position.

The pump has a tube retaining mechanism. Selective movement of a movable retainer associated with the tube retaining mechanism as well as movement of the tube retaining mechanism independently of the movable retainer is determined at least in part by selective movement of the support structure.

A linkage mechanism for the pump includes an actuating lever and a link arm, a pivot point permitting the actuating lever to pivot about the link arm. A first end of the linkage mechanism is selectively connected to the support structure and a second end of the linkage mechanism is selectively connected to the pump body. The pivot point is disposed between the first end and the second end. When the actuating lever is in a closed position, the linkage mechanism locks the support structure to the pump body to lock the pump.

BRIEF DESCRIPTION OF THE DRAWINGS

Throughout the drawing figures, like reference numerals will be understood to refer to like parts and components.

DETAILED DESCRIPTION

Figure 1:
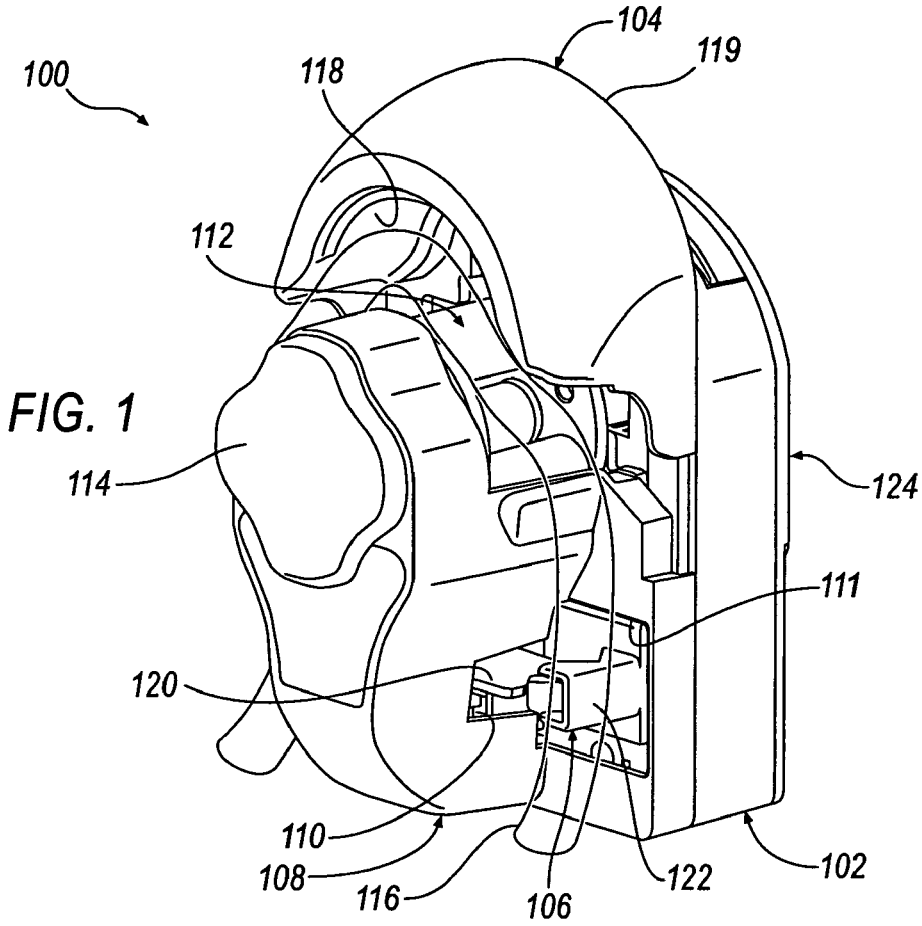
FIG. 1 is a front perspective view of an exemplary embodiment of a peristaltic pump in the open position ready to accept a tube.

An exemplary embodiment of a peristaltic pump 100 is shown in an open position in FIG. 1. It includes a pump body 102. A support structure 104 is movably secured to a front surface of pump body 102, both components having generally planar portions that are brought into a facing relationship with each other. The planar portions are perpendicular to an axis of rotation A-A, defined below, and include, for purpose of description, both a vertical axis and a horizontal axis of pump 100. In turn, a tube retaining mechanism 106 is associated with a front surface of support structure 104. A front cover 108 with an opening 110 receives a portion of retaining mechanism 106 in a manner such that the retaining mechanism is disposed between support structure 104 and the front cover 108. Moreover, front cover 108 and pump body 102 secure a rotor assembly 112, the rotor assembly rotating about a fixed axis A-A defined by a central shaft 113 (FIG. 3) of the rotor assembly. Shaft 113 extends through both front cover 108 and pump body 102. A front cap 114 is secured to the front surface of the front cover 108 and permits access to shaft 113 of rotor assembly 112. A rear cover 124 is secured to the back of the pump body 102, shaft 113 passing through the rear cover.

A tube 116 is disposed between an arcuate working surface 118 adjacent to an upper edge 119 of support structure 104 and rotor assembly 112 and passes through two pairs of retainers 120, 122 of tube retaining mechanism 106, each pair of retainers being disposed on opposite lateral sides of rotor assembly 112. Thus, the tube 116 follows a generally U-shaped path. The ends of tube 116 extend from a common side of pump 100, namely away from the bottom of the pump in the orientation shown in FIGS. 1 and 2. Further, they are located adjacent the same end of the pump, namely the front end, in the illustrated embodiment. Installation and removal is simplified by having tube 116 extend from a common side and being located adjacent the same end of pump 100. While a particular side and end is illustrated, the invention is not limited to the illustrated embodiment.

Figure 2:
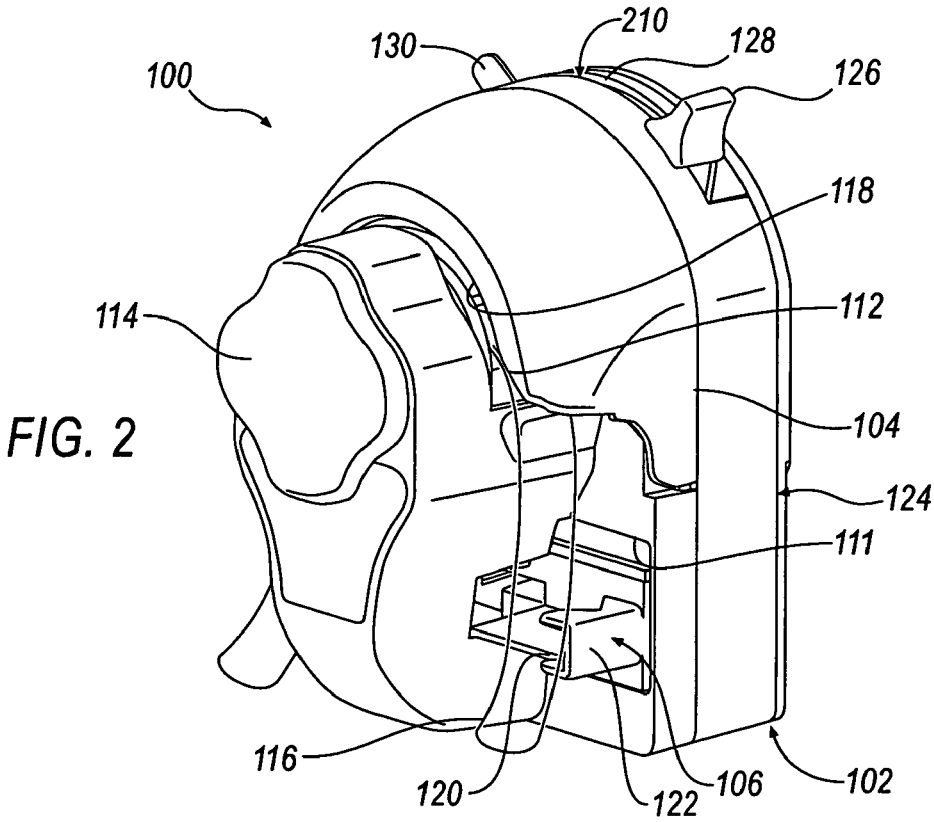
FIG. 2 is a front perspective view of the peristaltic pump shown in FIG. 1, but in a closed position.
Figure 3:
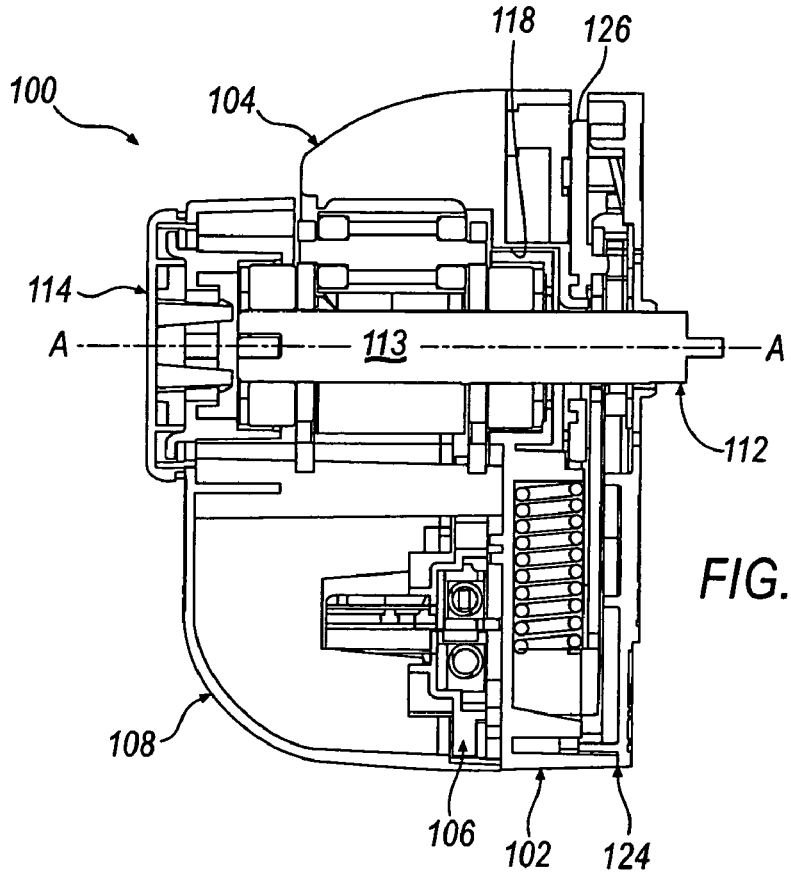
FIG. 3 is a cut-away side view of the peristaltic pump shown in FIG. 1, but in a closed position.
Figure 4:
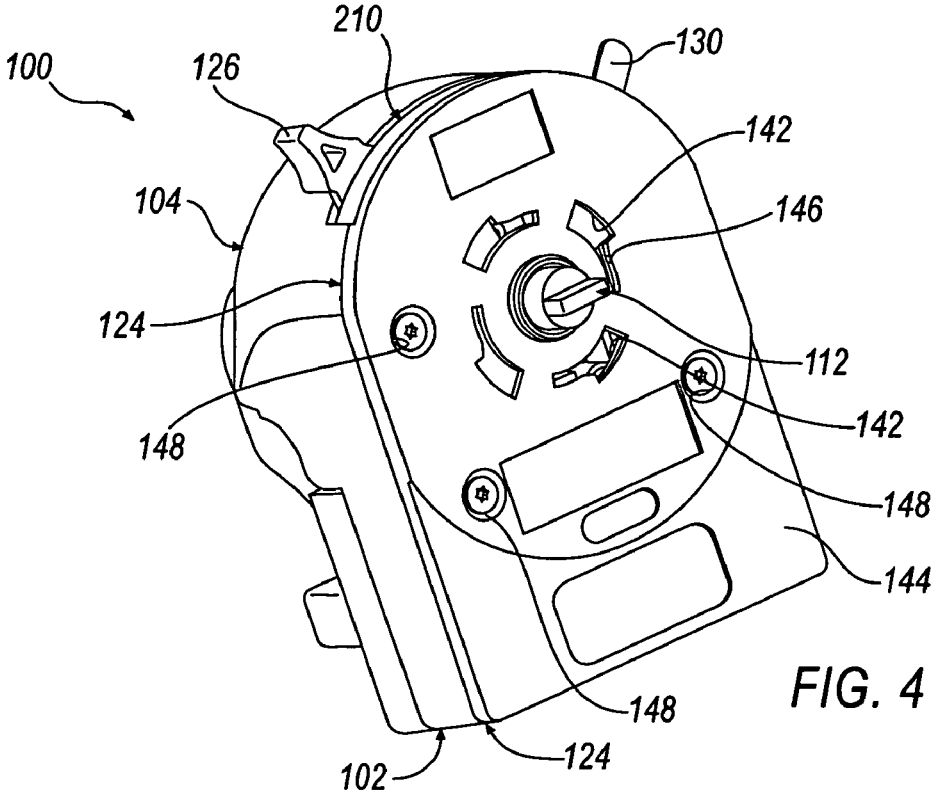
FIG. 4 is a rear perspective view of the peristaltic pump shown in FIG. 1, but in a closed position.

FIGS. 2 through 4 illustrate pump 100 in a closed orientation. FIG. 2 is a front perspective view, FIG. 3 is a cut-away of the pump from the side, and FIG. 4 is a rear perspective view. An actuating lever 126 is shown extending away from a side portion of pump body 102 and is disposed within a groove 128 defined by the pump body and rear cover 124. The movement of actuating lever 126 between open and closed positions at opposite ends of groove 128 permits the overall pump 100 to open and close, respectively, as discussed in detail below.

When actuating lever 126 is in the closed position visible in FIGS. 2 through 4, working surface 118 of support structure 104 is disposed much closer to rotor assembly 112 than when pump 100 is open. The arcuate aspect of working surface 118 complements the shape of rotor assembly 112. As a result, tube 116 is pinched between working surface 118 and rotor assembly 112. Further, when pump 100 is closed, retainers 120, 122 of tube retaining mechanism 106 restrain tube 116 as discussed below. Moreover, tube 116 is stretched along its axis of extension. As a result, when shaft 113 of rotor assembly 112 rotates about axis A-A, the areas where tube 116 is squeezed move along working surface 118 of support structure 104, creating pressure ahead of the squeezed area and vacuum behind that area.

Finally, a mounting plate lock 130 is shown in FIG. 2 that extends away from a side of pump body 102 and is disposed between the pump body and rear cover 124. Mounting plate lock 130 permits pump 100 to be removably attached to a motor assembly and/or a control mechanism (not shown), including a mounting plate 132, which will control the rotation of shaft 113.

Figure 5A:
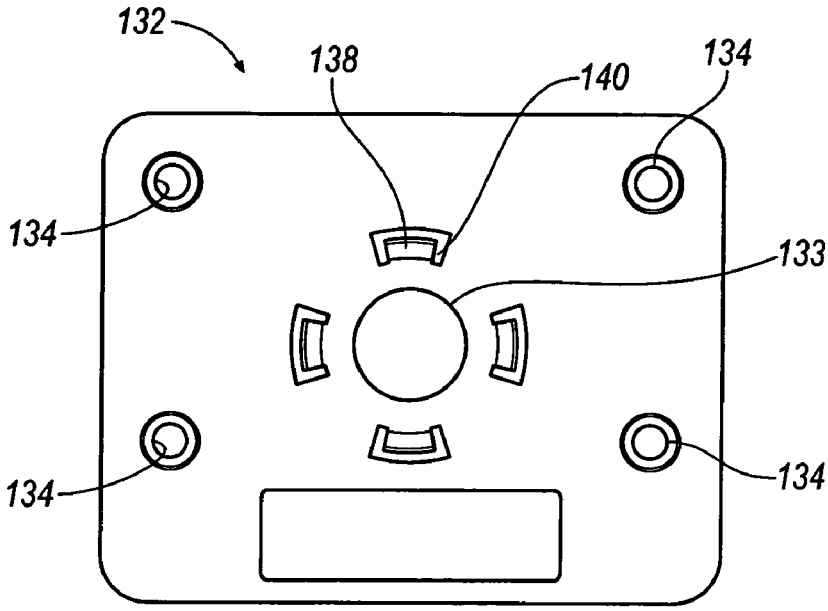
FIGS. 5A and 5B are front and rear views of a mounting plate, which attaches to the rear surface of a rear cover of the peristaltic pump of FIGS. 1-4, and adapts the pump for use with various rotary drives.
Figure 5B:
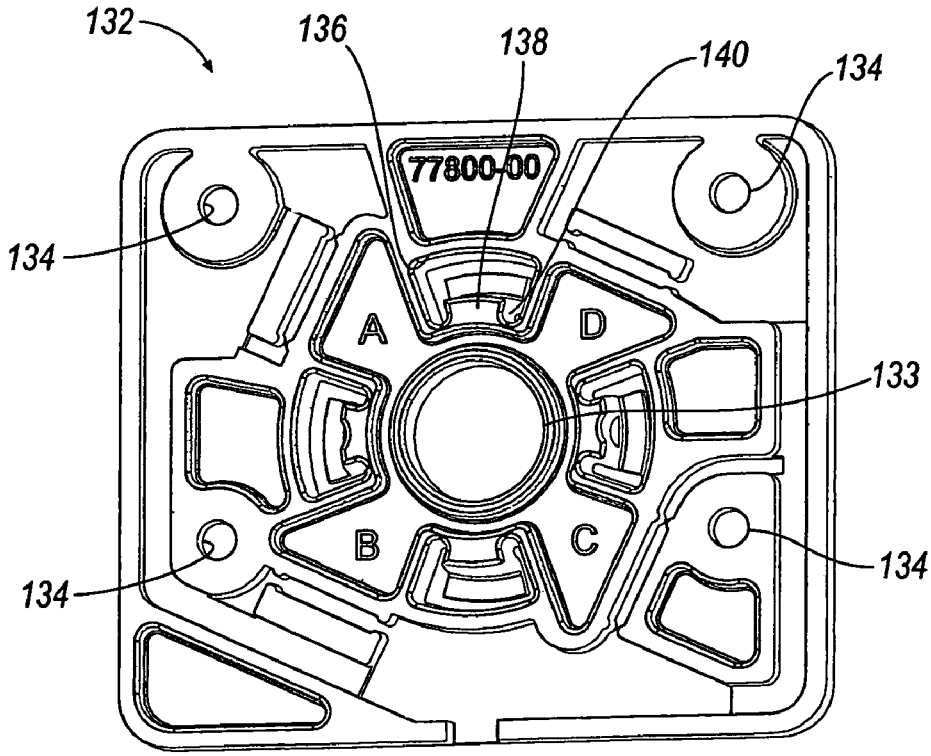

The generally rectangular mounting plate 132, not shown in FIGS. 1 through 4, is illustrated in FIGS. 5A and 5B and is used with pump 100. It includes an orifice 133 for receiving shaft 113. Mounting plate 132 also includes apertures 134. In the exemplary embodiment, four apertures 134 are shown disposed relatively near each of the four corners. The apertures 134 permit fasteners to pass through the mounting plate 132 to secure it to a motorized drive.

To help facilitate the securement of mounting plate 132 to rear cover 124, the mounting plate includes a plurality of openings 136 and corresponding tangs 138 disposed outwardly of and angularly spaced about orifice 133. The tangs 138 are spaced circumferentially at approximately ninety degree increments about axis A-A. Each tang 138 extends radially outwardly from an inner periphery 140 of the opening 136. The tangs 138 are mated with corresponding openings 142 formed through a rear face 144 in rear cover 124 (as shown in FIG. 4), each opening 142 having a circumferentially extending slot 146 sized to trap a corresponding tang 138. The tangs 138 engage the openings 142 of rear cover 124, and the entire mounting plate 132 is then twisted about axis A-A so that each tang extends into a corresponding slot 146 and grips a front face of the rear cover 124 while the rest of the mounting plate grips the rear face 144 of rear cover 124. The invention contemplates greater or fewer fasteners or tang combinations as well as different fastening mechanisms. One advantage of the proposed arrangement of tangs 138, however, is that when a pump is arranged with respect to a drive, it can be oriented in any one of four positions. As a result, when multiple pumps 100 are placed in series with respect to one another, as discussed in greater detail below, adjacent pumps can be rotated approximately ninety degrees with respect to each other if desired by the user.

In general, pump body 102, support structure 104, front cover 108, front cap 114, rear cover 124, and mounting plate 132 are independently molded. While various materials may be used, including glass and mineral-filled Polyphenylene Sulfide ("PPS"), preferably the material is a glass-filled polypropylene. The goal is to have a material with an adequate bulk modulus to provide rigidity. Key elements of each component are made using a single non-moving mold element with tight tolerances and in a manner that minimizes tolerance stack up between related components. For example, in one preferred embodiment of the support structure 104 the locating surfaces 232 and 234 (discussed in greater detail below) are formed from the same block of steel that is used to form working surface 118. In a preferred pump body 102, location surfaces 216 and 218 (discussed in greater detail below) are created and formed from the same block of steel that is used to form the counter bore 195 (discussed below) used to locate the rotor 112.

Figure 6:
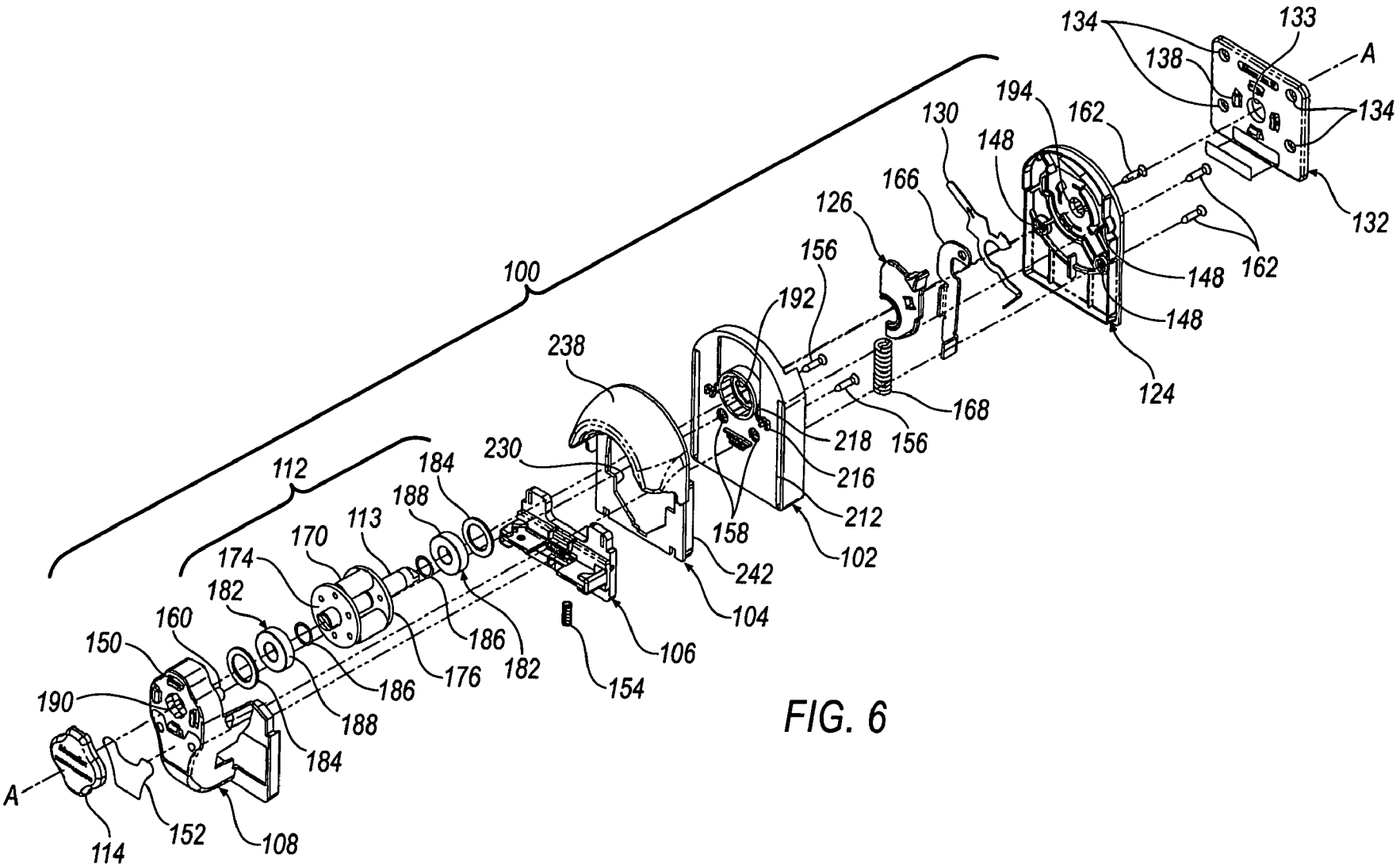
FIG. 6 is an exploded view of the overall peristaltic pump shown in FIG. 1.

As a result of the careful construction and the innovative interaction of the integrally molded components and their respective elements, the positioning of tube 116 between working surface 118 and rotor assembly 112 is very accurate, creating a superior peristaltic pump. FIG. 6 is an exploded perspective front view of peristaltic pump 100 and is used in combination with the figures that follow to show the construction and operation of peristaltic pump 100 in greater detail. As noted above, axis A-A is defined by shaft 113 of rotor assembly 112.

Front cap 114 is shown clipped to front cover 108. However, front cover is also shown with tangs 150, which can mate with openings 142 of a rear cover 124 of a second pump 100 so that multiple pumps 100 can be placed in series with one another. An optional label 152 is shown disposed on the front cover 108.

Tube retaining mechanism 106 is disposed between front cover 108 and support structure 104. Both support structure 104 and rotor assembly 112 are disposed between front cover 108 and pump body 102. A spring 154 is also illustrated and is used to selectively move retaining mechanism 106 upward away from a bottom edge of front cover 108 as support structure 104 moves upwardly. Spring 154 is discussed in greater detail below with respect to FIGS. 17 and 18.

Fasteners in the form of threaded bolts or screws 156 pass through pump body 102 through mating apertures 158 and are received in threaded receptacles or posts 160 (best shown in FIG. 17) formed in a rear face 211 the front cover 108 although a variety of other securement mechanisms may also be used. A separate collection of threaded fasteners 162 passes through apertures 148 of rear cover 124 to be received in threaded receptacles 164 (shown in FIG. 22) formed in a rear face pump body 102. While threaded fasteners are shown to secure the various components of pump 100 together along axis A-A, many other mechanism can be used including tabs and slots or welds and adhesives.

Actuating lever 126, a link arm 166 and a biasing mechanism in the form of a spring 168 are disposed between pump body 102 and rear cover 124, collectively acting as an actuation linkage for moving support structure 104 with respect to pump body 102. When support structure 104 is moved from an open position to a closed position, tube 116 is pinched between working surface 118 and rotor assembly 112, tube retaining mechanism 106 restrains the tube, and the tube is stretched along its extent between the rotor assembly and the tube retaining mechanism. The function of each of these elements is discussed further below.

Rotor Assembly

Figure 7:
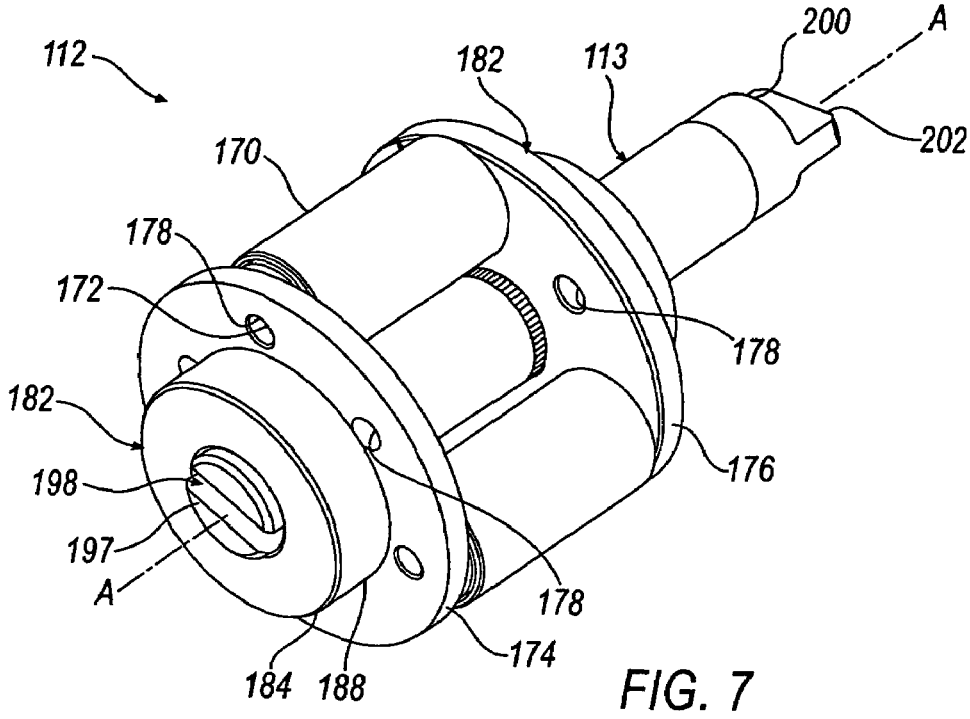
FIG. 7 is a front perspective view of the rotor assembly of the peristaltic pump show in FIG. 1.

FIG. 7, in combination with FIG. 6, illustrate rotor assembly 112. Rotor assembly 112 comprises a series of rollers 170 disposed about axles 172 between a front rotor plate 174 and a rear rotor plate 176. Three rollers generally equally spaced at 120 degree increments is preferred, but more rollers (e.g., four rollers generally spaced at 90 degree increments) could also be used in pump 100. Opposing ends of each axle 172 are received in aligned openings 178 of each rotor plate 174, 176. Rotor plates 174 and 176 are perpendicular to and affixed to central shaft 113, defining axis A-A. The relative spacing of front rotor plate 174 and rear rotor plate 176 is controlled so that the rollers 170 may readily rotate about their respective axle 172. Moreover, each roller 170 is preferably of essentially the same diameter and is located at essentially the same radius, the roller being equally spaced angularly about shaft 113 by virtue of their connection to rotor plates 174 and 176.

Outboard of each of the rotor plates 174, 176 is a bearing assembly 182 disposed about shaft 113. Each bearing assembly 182 may include an optional outboard washer 184 and an optional inboard washer 186 (see FIG. 6), with an appropriate bearing 188 disposed there between. Bearing assemblies 182 facilitate the rotation of shaft 113 with minimal friction, while permitting the rotor assembly to be appropriately secured so that shaft 113 may extend through orifices 190, 192, 194, and 133 of cover 108, pump body 102, rear cover 124 and mounting plate 132, respectively. Bearing assemblies 182 are received in counter bores 195 (See FIG. 8) and 196 (See FIG. 17) of pump body 102 and front cover 108, respectively. Front end 197 of shaft 113 includes a slot 198 to facilitate the use of multiple pumps 100 in series. Rear end 200 of shaft 113 includes a protrusion 202 with a bearing surface to facilitate the rotation of the shaft from the rear of peristaltic pump 100 when engaging an appropriate slot such as a slot 198 of a mating component. Other mechanisms for attaching to shaft 113 are also known and may be used to facilitate the operation of rotor assembly 112. Typically, the components of rotor assembly 112 are formed from either cold-rolled or stainless steel such as a series 300 stainless steel.

When multiple pumps 100 are used in series, a first pump 100 engages a motor mechanism, and that motor mechanism uses shaft 113 of the first pump 100 and each subsequent nested shaft 113 of the subsequent pumps to drive all engaged pumps. As noted above, the orientation of each adjacent pump may be offset approximately ninety degrees with respect to axis A-A.

Movement of Support Structure with Respect to Pump Body

Figure 8:
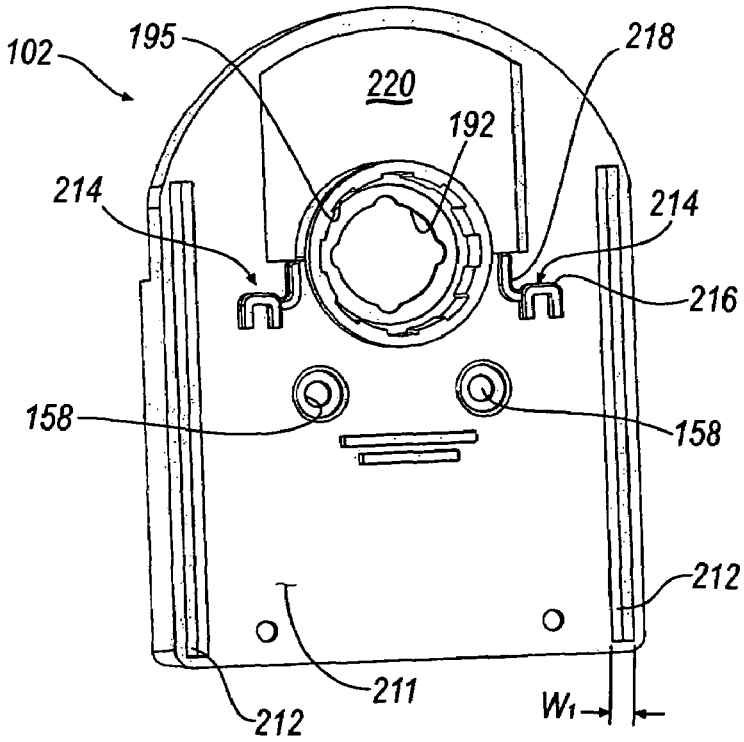
FIG. 8 is a front perspective view of a first embodiment of the pump body.
Figure 9:
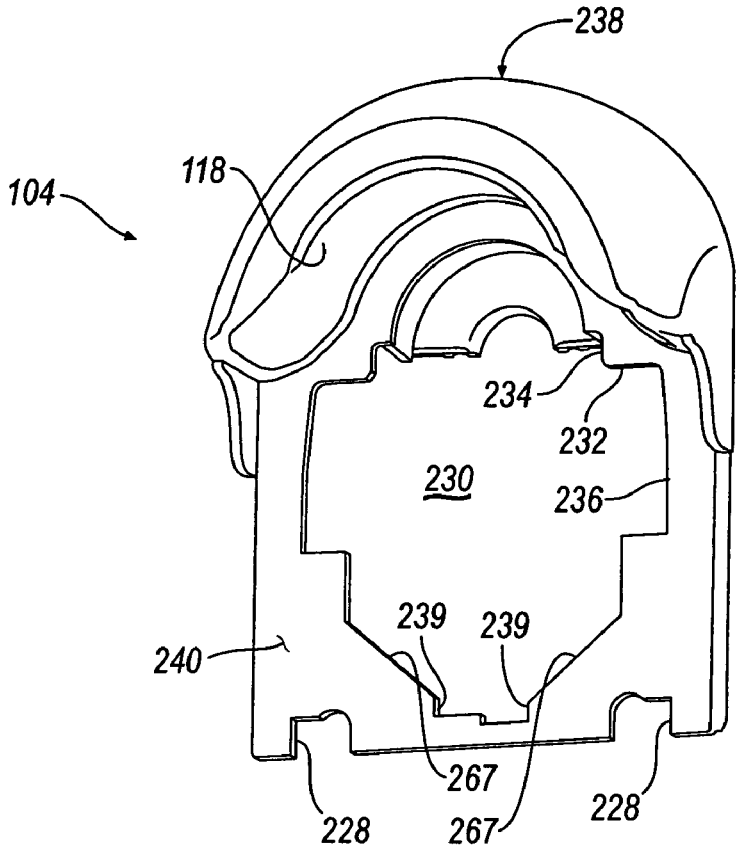
FIG. 9 is a front perspective view of an embodiment of the support structure for the peristaltic pump.
Figure 10:
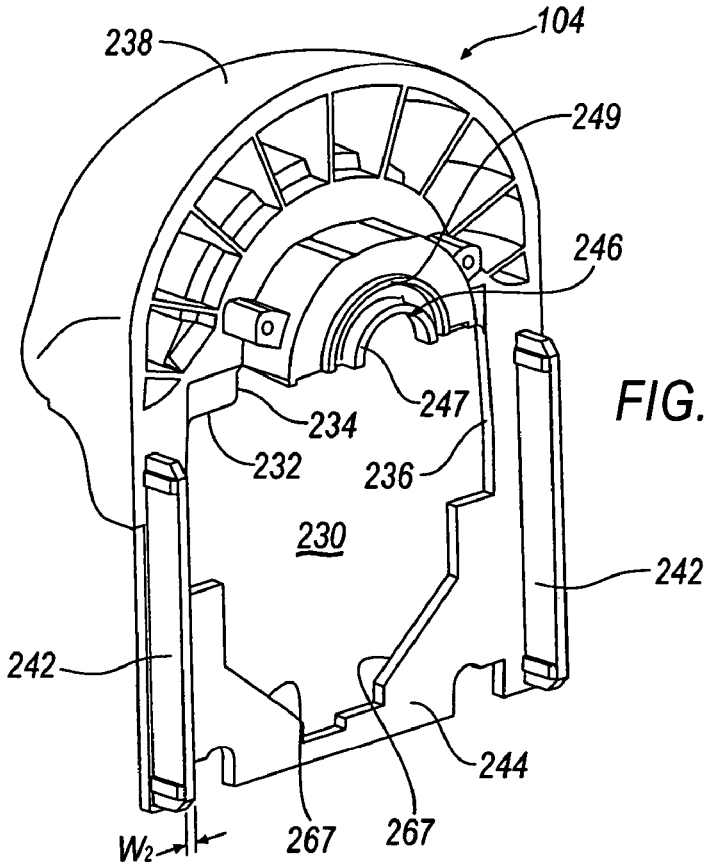
FIG. 10 is a rear perspective view of an embodiment of the support structure for the peristaltic pump.
Figure 11:
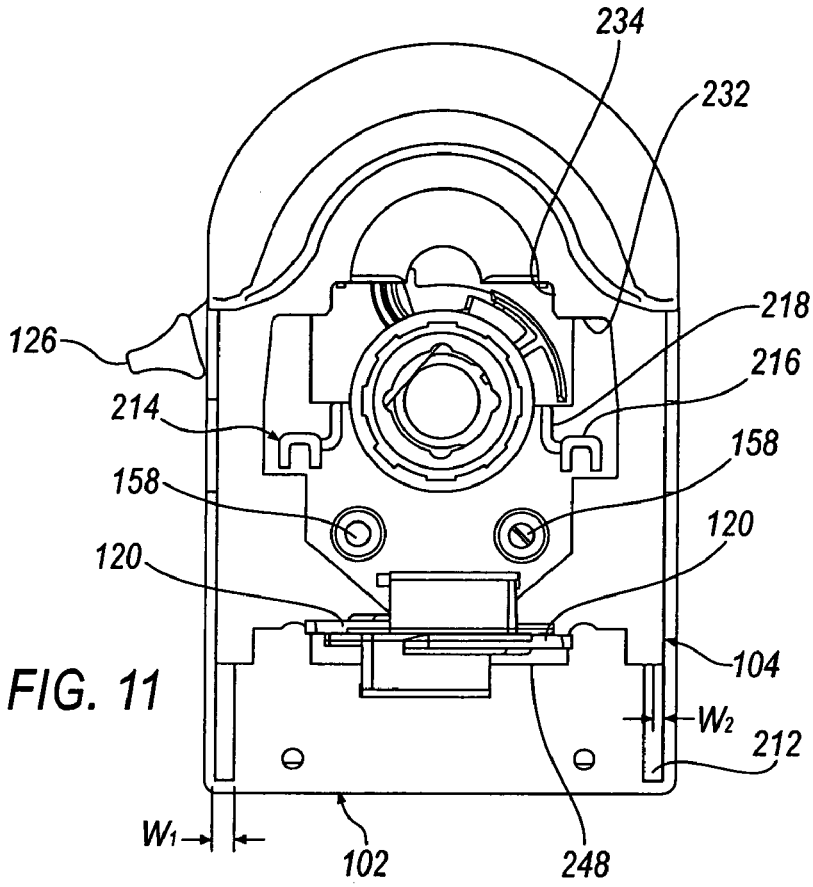
FIG. 11 is a front view of the support structure of FIGS. 9 and 10 with respect to the pump body of FIG. 8 when the pump is an open position. A portion of a tube retaining mechanism is also shown.
Figure 12:
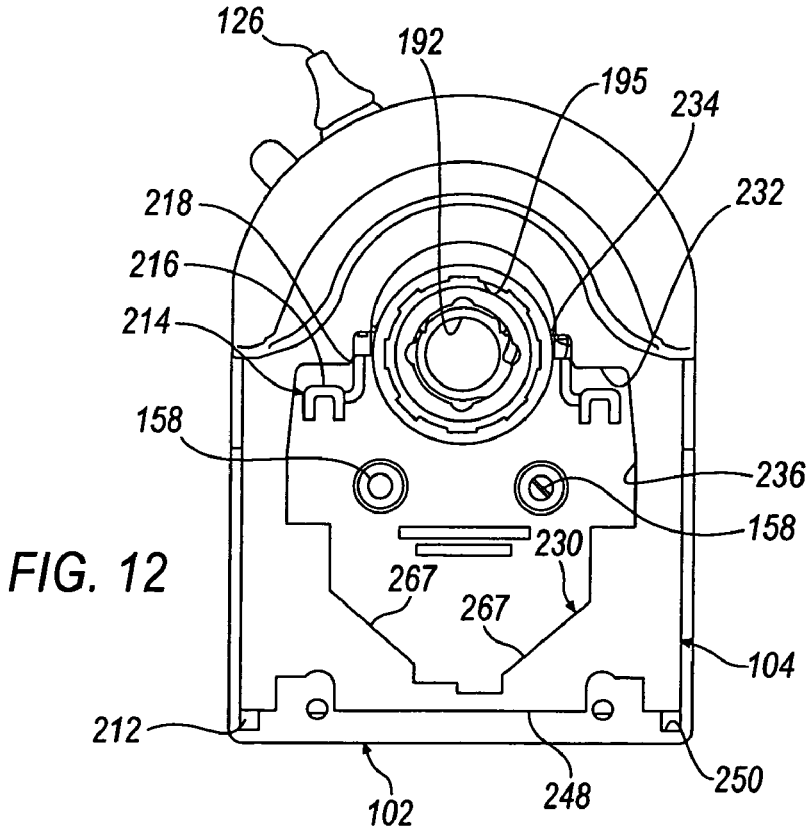
FIG. 12 is a similar view to FIG. 11 but shows the support structure with respect to the pump body when the pump is in a partially closed position.
Figure 13:
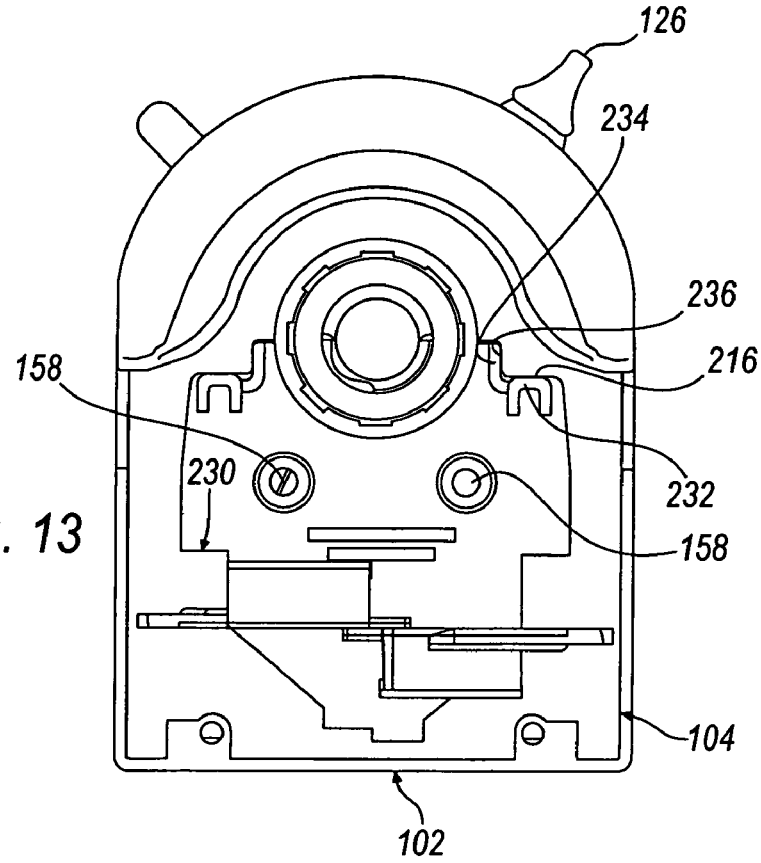
FIG. 13 is a similar view to FIGS. 11 and 12 but shows the support structure with respect to the pump body when the pump is in a closed position. A portion of the tube retaining mechanism is also shown.
Figure 14:
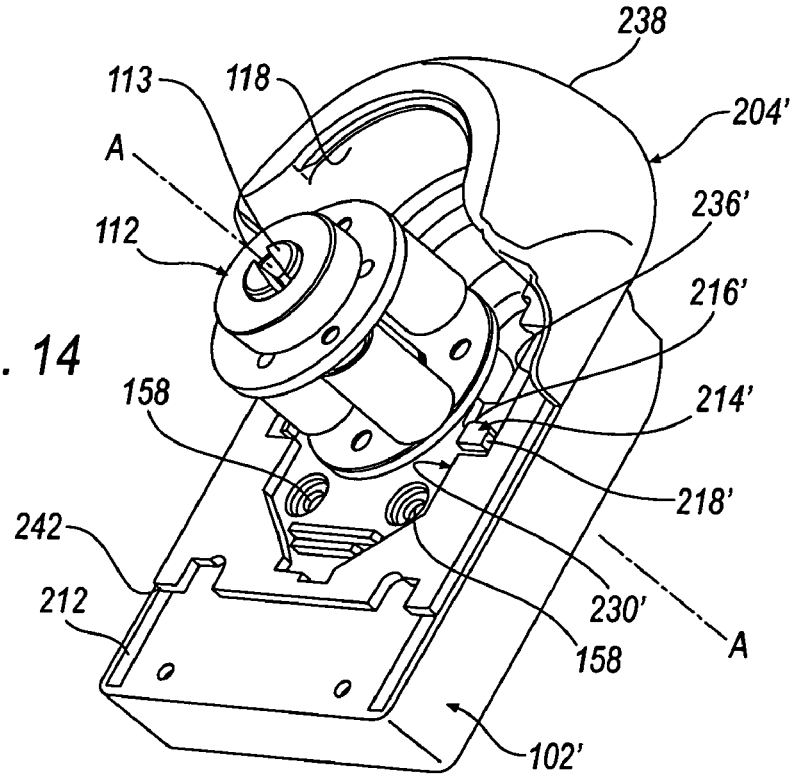
FIG. 14 is a front perspective view of a sub-assembly comprising an alternative embodiment of the pump body and the support structure and also including the rotor assembly.
Figure 22:
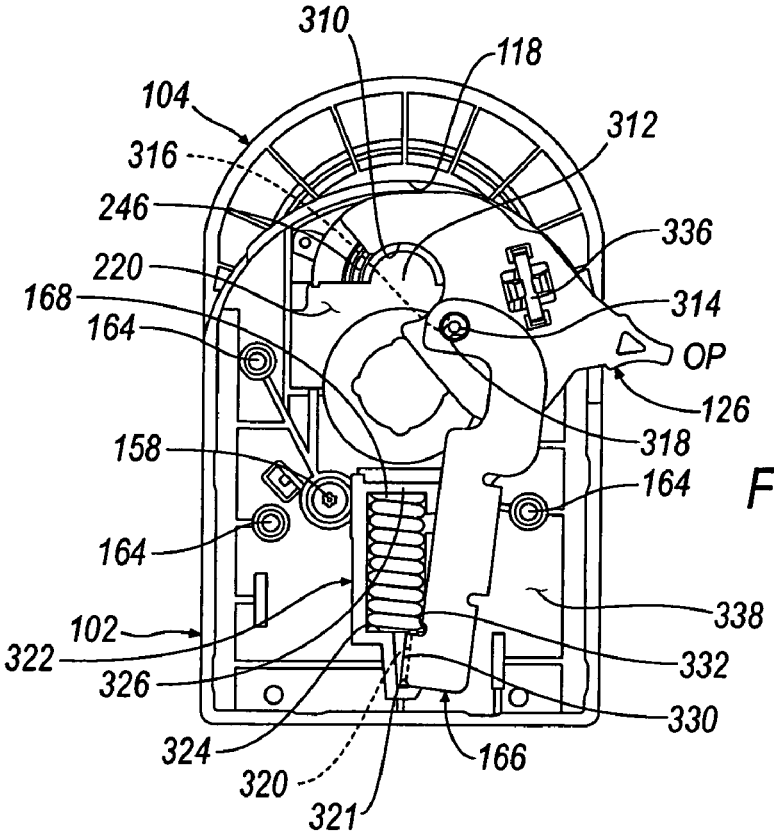
FIG. 22 is a rear view of a portion of the peristaltic pump in an open position and showing aspects of the actuation linkage of the pump in accordance with a first embodiment of a biasing member.

An illustrative embodiment of pump body 102 is shown in a front perspective view in FIG. 8 with a rear view best shown in FIG. 22. FIGS. 9 and 10 show front and rear perspective views of support structure 104, respectively. FIGS. 11 through 13 show the relative movement of support structure 104 with respect to pump body 102 as it moves from an open, to a partially closed, and then fully closed orientation. FIG. 14 illustrates an alternative embodiment of a pump body 102' with respect to support structure 104 and rotor assembly 112.

As discussed above, pump body 102 includes an orifice 192 for receipt of shaft 113 and a counter bore 195 to retain one of the bearing assemblies 182 of rotor assembly 112. It also includes apertures 158 through which bolts 156 pass to be secured to front cover 108 and threaded receptacles on the back surface for receiving threaded fasteners 162 passing through rear cover 124. Pump body 102 further includes a slot 210 at its uppermost surface that forms three of the four surfaces of groove 128 (FIGS. 2 and 4).

A locating mechanism helps to locate pump body 102 with respect to support structure 104. In the discussion that follows, the various elements are exemplary, it being recognized that a subset of the elements may be used in practice or that some of the elements discussed with respect to either the support structure 104 or the pump body 102 can be exchanged with the other component.

In the illustrated embodiment, a front face 211 of pump body 102 has a pair of generally vertically extending locating grooves 212, each having a width "$W_1$" disposed adjacent to each lateral edge of the body, and two locating features 214 extending away from the front face of the pump body and located adjacent to but downwardly of the centered portion of orifice 192. The two locating features 214 each include a first locating surface 216 and a second locating surface 218 generally perpendicular to the first locating surface. Each locating surface 216, 218 is shown associated with a separate member, but this is not required as discussed below. In the illustrated embodiment, there is a pair of locating surfaces 216, 218, which are disposed on opposite sides of orifice 192. Locating surfaces 216 are preferably perpendicular to grooves 212.

In the illustrated embodiment grooves 212 and locating surface 218 are generally parallel to each other and extend generally perpendicularly to a horizontal surface defined by locating surface 216. Pump body 102 also includes an upper opening 220 that begins above and is generally laterally defined between locating members 216. Opening 220 receives bearing surface 246 of support structure 104 as illustrated, for example, in FIG. 22.

Front and rear perspective views of support structure 104 are illustrated in FIGS. 9 and 10, respectively. Support structure 104 forms a sub-assembly with pump body 102 in FIGS. 11 through 13 as pump 100 moves from an open position to a closed position. Two notches 228 extending upwardly from the bottom edge of support structure 104 are discussed below in relationship to the operation of tube retaining mechanism 106. Support structure 104 has an opening 230 that is shaped to receive projections 307 (FIG. 17) of tube retaining mechanism 106, avoid any interference with shaft 113 of rotor assembly 112 (as shown in the alternative embodiment of FIG. 14), and appropriately mate with pump body 102. The periphery of opening 230 includes a pair of generally horizontal alignment edges 232 for selective engagement with locating surface 216, and a pair of generally vertical alignment edges 234 for selective engagement with corresponding locating surface 218 of pump body 102. Opening 230 also includes opposed lateral edges 236. A lower portion of opening 230 includes two sloped lateral edges 267 (shown generally angled as part of the lateral periphery of opening 230 in illustrated embodiment) and two vertical edges 239, the function of which is discussed below with respect to the opening and closing of movable retainers 120 of tube retaining mechanism 106. As also best shown in FIGS. 11 through 13, a lower portion of opening 230 is sized to permit the passage of fasteners 156 through apertures 158 without interfering with the movement of support structure 104.

An upper portion 238 of support structure 104 defines a working surface 118. The upper portion 238 and working surface 118 each extend away from a front face 240 of support structure 104 in a forwardly direction. Front face 240 is generally defined by a plane perpendicular to axis A-A. Working surface 118 is a segment of a figure of revolution. Its axis of rotation must generally be coincident with axis A-A for proper operation of pump 100.

As shown in FIG. 10, projections, shown in the form of locating rails 242 of width "$W_2$", are selectively received within locating grooves 212 (as seen in FIG. 8) extend away from a rear face 244 of support structure 104. While other forms of projections may also be used, rails 242 in combination with grooves 212 help to provide additional guidance between support structure 104 and pump body 102.

The length of rails 242 is controlled with respect to grooves 212 so that pump 100 can move between its closed and open positions through the up and down movement of support structure 104. Preferably, the width "$W_2$" is less than a corresponding width "$W_1$" of groove 212. As a result, the possibility of inadvertent binding is minimized. An arcuate bearing track 246 with two raised arcs 247 and 249 is generally coaxial with axis A-A and also extends away from the rear face and provides a bearing surface for actuating lever 126 as best shown in FIG. 22 and discussed below. The lower arc 247 of bearing track 246 forms a portion of the periphery of opening 230.

When support structure 104 is mated with pump body 102 as shown in FIGS. 11 through 13, rails 242 are received within grooves 212 and locating features 214 engage opening 230, the periphery of which selectively engages the locating feature, as discussed above. When pump 100 is moved from the opened to the closed position, the support structure 104 can align itself with respect to pump body 102. As a result, when pump 100 is closed, support structure 104 is extremely accurately positioned with respect to pump body 102 and through the automatic interaction of the various elements of both the support structure and the pump body in combination with a linkage mechanism, discussed below, locked against either horizontal or vertical movement without requiring user intervention.

FIG. 11 shows a portion of pump 100 in an open position where a bottom edge 248 of support structure 104 and a bottom edge of pump body 102 are separated. For clarity one of the components not shown in FIG. 11 is rotor assembly 112. As discussed in more detail below, retainers 120 of tube retaining mechanism 106 are separated from their opposing retainer 122 (not shown for simplicity). FIG. 12 shows peristaltic pump 100 in a partially closed position and with actuating lever 126 displaced clockwise with respect to its initial orientation when looking from the front of pump 100 toward the rear. The movement of actuating lever 126 is for illustration, only. For further simplicity, retainers 120 are not shown in FIG. 12. Peristaltic pump 100 is completely closed in FIG. 13, wherein once again actuating lever 126 has been displaced further clockwise. Actuating member 126 is shown displaced from both its initial orientation and its partially closed orientation. Locating surface 216 has engaged alignment edge 232 and locating surface 218 has engaged alignment edge 234. In one possible embodiment, an upper edge of locating surface 218 is slightly angled toward orifice 192 to help minimize the likelihood of surface 232 stopping against an edge of locating surface 218 as the locating feature 214 engages the appropriate edges of opening 230. However, once pump 100 is completely closed as shown in FIG. 13, support structure 104 is accurately positioned both vertically and horizontally with respect to pump body 102. As a result, excellent flow and pressure characteristics result from the interaction between working surface 118, integral with support structure 104, and rotor assembly 112 located with great accuracy on pump body 102.

An alternative embodiment of pump body 102' is shown in FIG. 14 secured to an alternative embodiment of support structure 104' and in combination with rotor assembly 112. The overall operation of locating features 214' with respect to opening 230' is generally similar to that discussed above with respect to FIGS. 1 through 13. Locating feature 214', however, comprises an outer generally vertical surface 218' and a generally horizontal surface 216' as part of a single locating member. Edge 236' of opening 230' may be inclined toward orifice 192 (shown in FIG. 8) to help center support structure 104' with respect to pump body 102' as pump 100 moves to a closed position. Once the pump is closed, however, the locating features 214' of pump body 102' should be engaged with a corresponding surface of support structure 104'.

Tube Retaining Mechanism

FIGS. 15 through 21 illustrate the use of tube retaining mechanism 106. Tube retaining mechanism 106 is designed to allow the ends of tube 116 to enter and exit pump 100 from the same side of the pump, namely the side opposite the working surface 118 of the support structure 104, which in the illustrated embodiment is the bottom side. Moreover, as noted above, tube 116 is located adjacent an end of the pump, which is the front end in the illustrated embodiment In general, retainers 120 and 122 prevent tube 116 from being pulled through pump 100 by the influence of the moving rollers 170 of rotor assembly 112. Each pair of retainers includes a moving retainer 120 and an opposing fixed retainer 122 mounted to retainer carrier 266. The motion of the moving retainer 120 with respect to corresponding retainer 122 is approximately perpendicular to the axis of the tubing to properly restrain tube 116 with respect to rotor assembly 112 as pump 100 is closed. During at least the latter portion of the closure of pump 100, and after retainers 120,122 have secured tube 116, the entire retaining mechanism 106 is moved away from the rotor assembly 112. Since tube 116 is already affixed to rotor assembly 112, the tube is stretched along its tubing axis, resulting in longer tube life.

Not only does tube retaining mechanism 106 ensure proper retention of tube 116 while also providing longer life of the tube, but the mechanism operates automatically without manual intervention as support structure 104 is moved up and down with respect to pump body 102 to open and close pump 100. Moreover, retainers 120 automatically open and close as pump 100 opens and closes, greatly speeding up the loading and unloading process, and permitting automatic centering of tube 116 along the length of rollers 170 by pump 100 itself so that the tube is accurately oriented between working surface 118 and rotor assembly 112 and under the appropriate loading conditions to ensure optimal pump operation and extended tube life.

Figure 15:
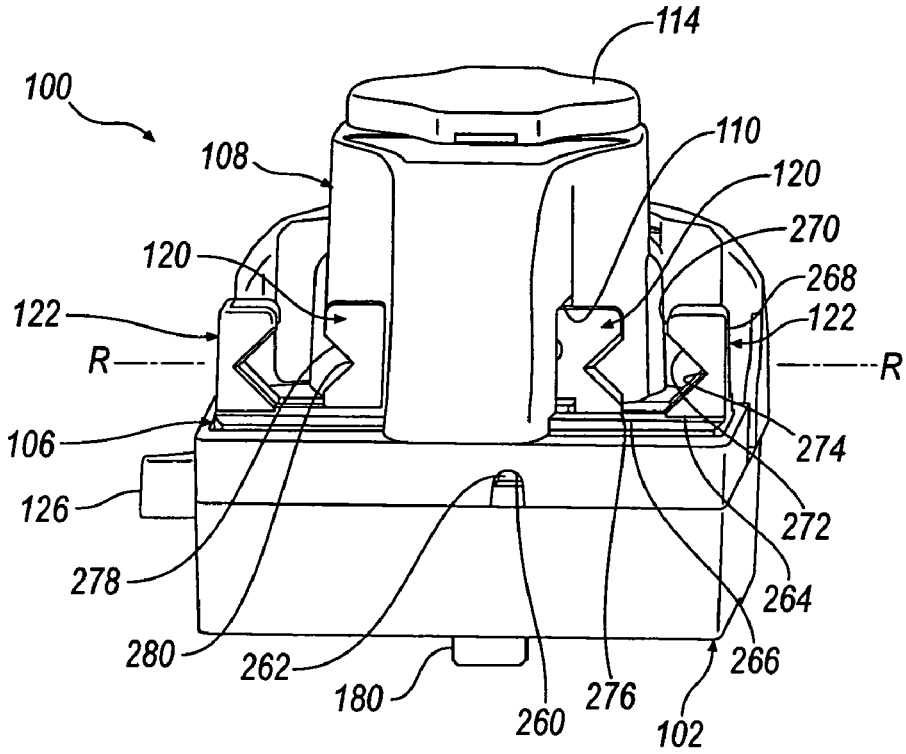
FIG. 15 is a bottom perspective view of the peristaltic pump of FIG. 1 with the tube retaining mechanism in the open position.
Figure 16:
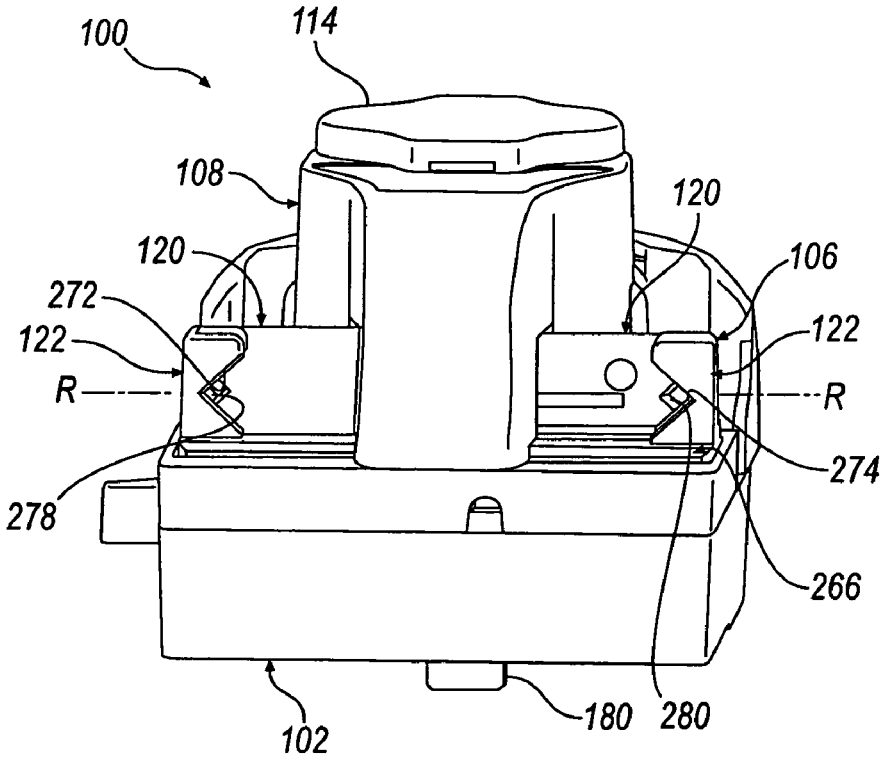
FIG. 16 is a bottom perspective view of the peristaltic pump of FIG. 1 with the tube retaining mechanism in the closed position.
Figure 17:
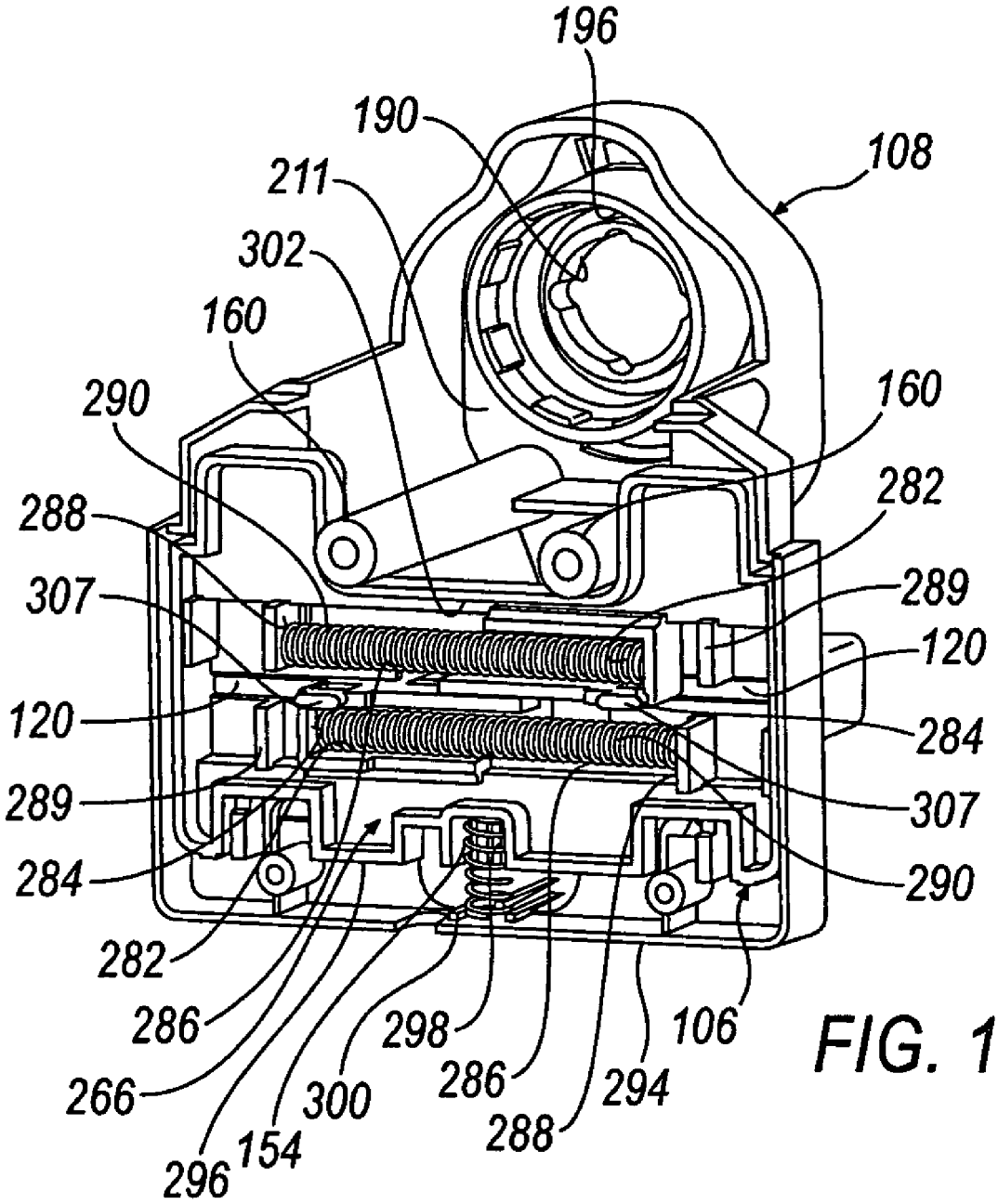
FIG. 17 is a rear perspective view of a sub-assembly of the peristaltic pump of FIG. 1 showing the tube retaining mechanism secured within the front cover.
Figure 18A:
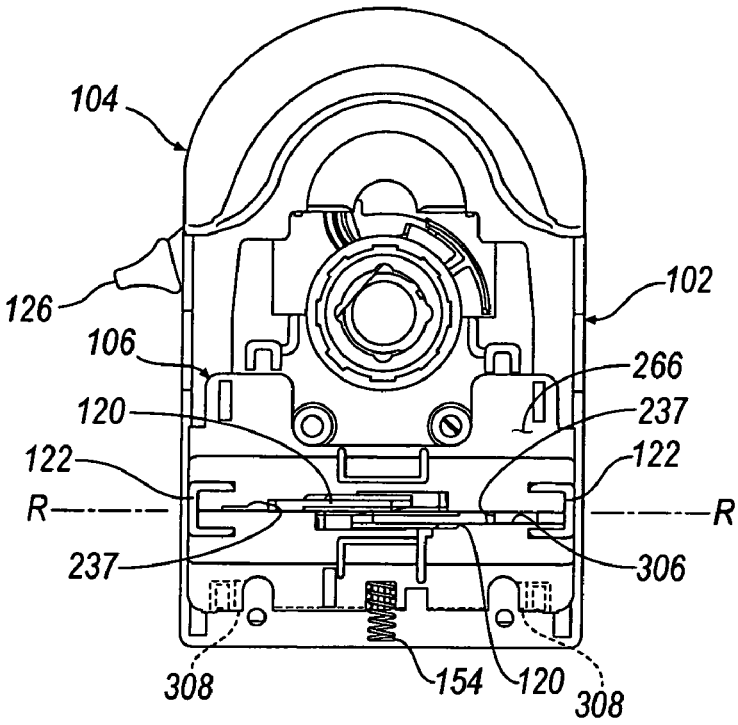
FIGS. 18A and 18B are a front and perspective view of a sub-assembly of the peristaltic pump of FIG. 1 showing the tube retaining mechanism secured to the support structure. Only a portion of the movable retainers is shown. The mechanism is shown in the open position.
Figure 18B:
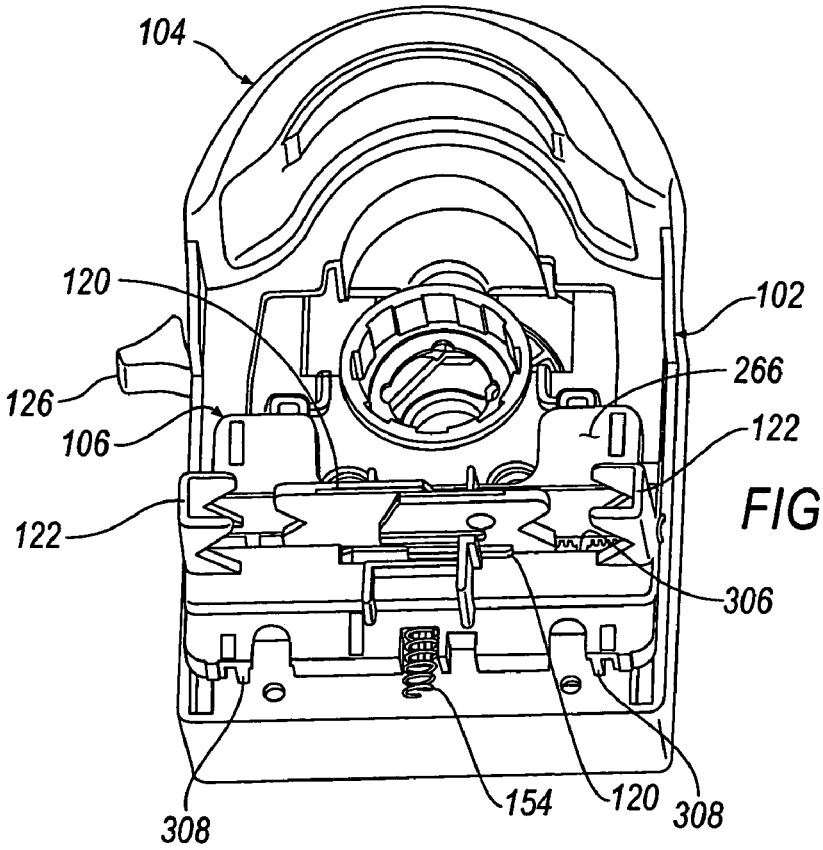
Figure 19A:
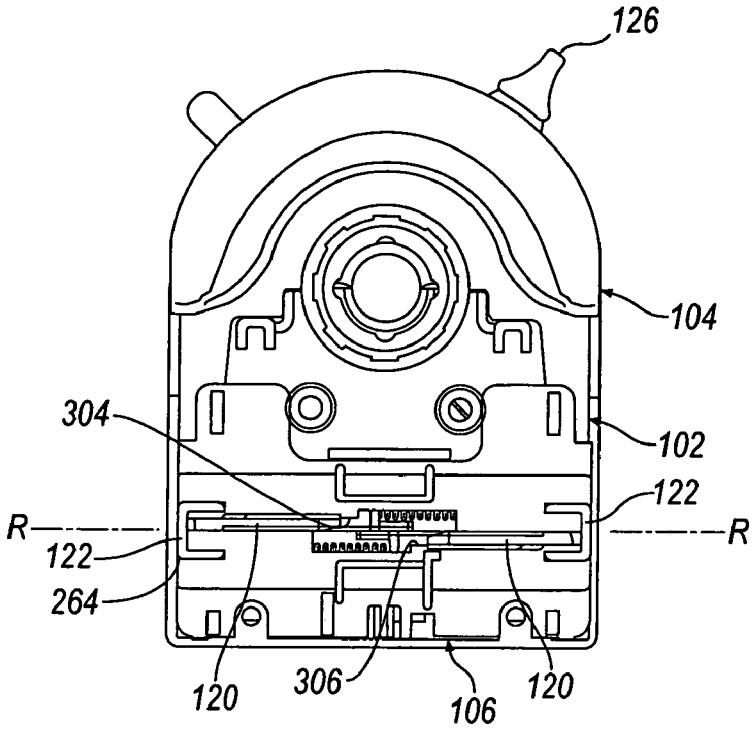
FIGS. 19A and 19B are a front and perspective view of a sub-assembly of the peristaltic pump of FIG. 1 showing the tube retaining mechanism secured to the support structure. Only a portion of the movable retainers is shown. The mechanism is shown in the closed position.
Figure 19B:
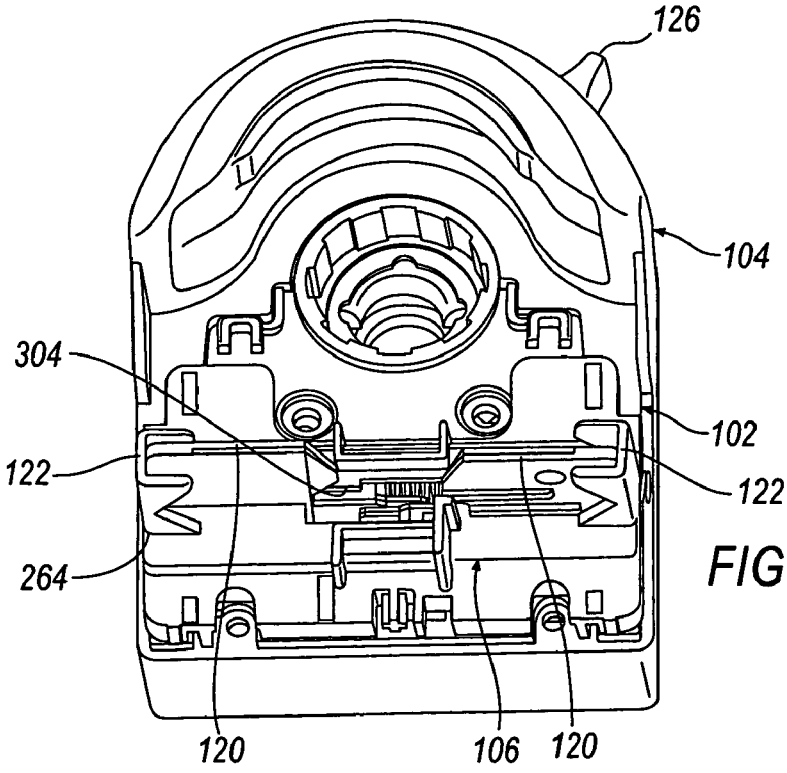
Figure 20:
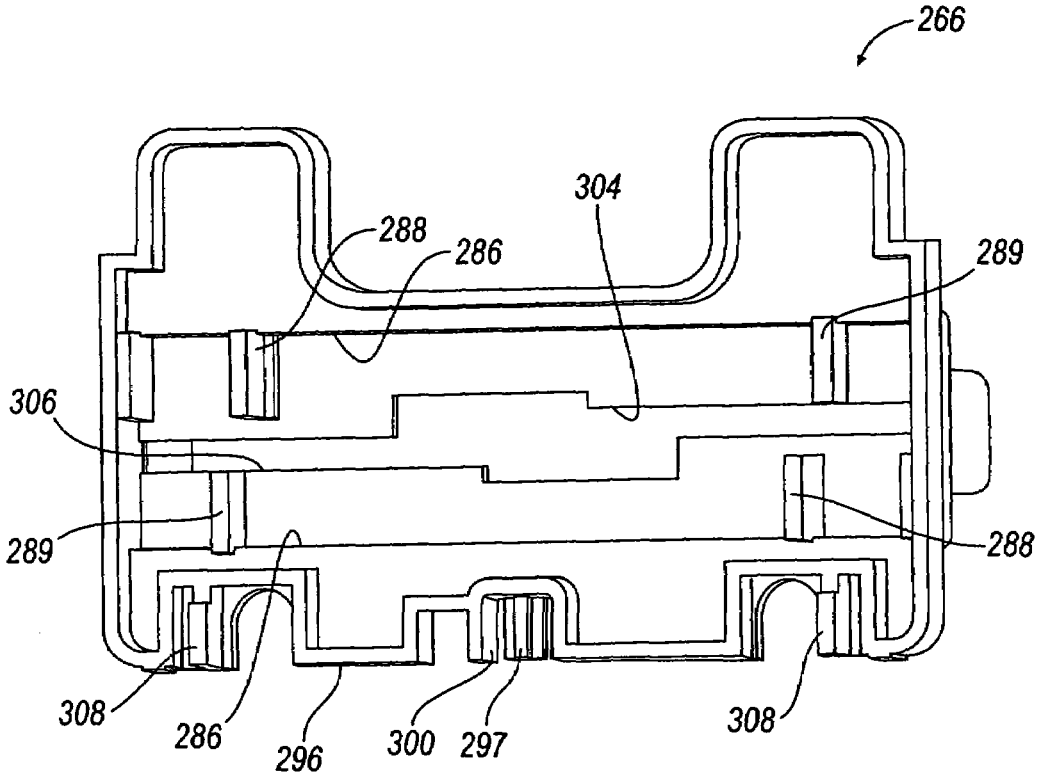
FIG. 20 is a rear perspective view of an embodiment of a retainer carrier component of the peristaltic pump.
Figure 21:
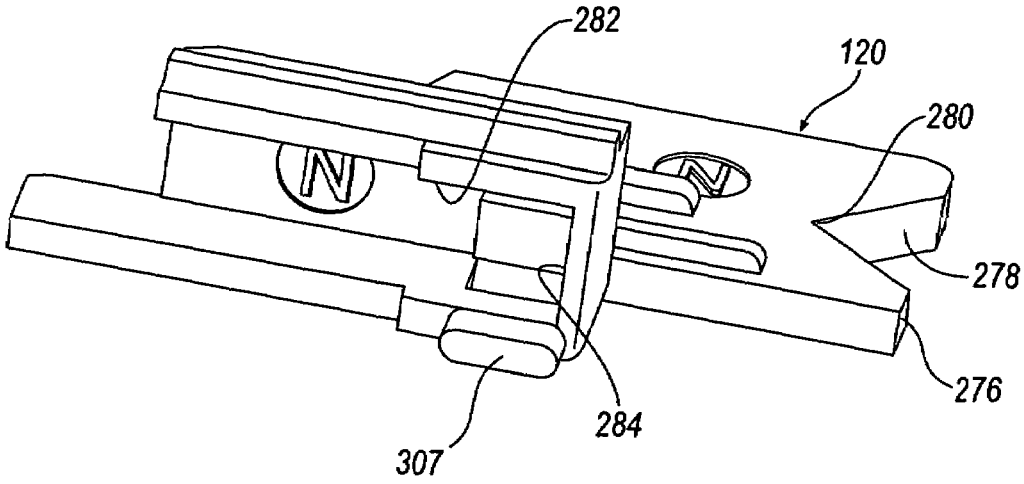
FIG. 21 is a perspective view of a movable retainer component of the peristaltic pump.

FIGS. 15 and 16 are bottom perspective views showing the tube retaining mechanism in an open and a closed position, respectively. FIG. 17 shows a rear perspective view of the tube retaining mechanism 106 as assembled with front cover 108. FIGS. 18 and 19 are views of tube retaining mechanism 106 without the front cover 108, again showing the pump in open and closed positions, respectively. FIG. 20 is a rear view of a retainer carrier while FIG. 21 is a perspective view of a movable retainer.

As illustrated in FIG. 15, the underside of a portion of peristaltic pump 100 is shown with front cover 108 secured to pump body 102. One of the members includes a notch 260 at a bottom surface, which receives a corresponding tab 262 from the other member to help locate the two members with respect to one another. In the illustrated embodiment, cover 108 includes the notch 260, and pump body 102 has the tab 262. In some embodiments there is no tab 262. However, a notch 280 provides a drain hole in case of inadvertent liquid flow from the pump 100. Cover 108 includes a center portion with opening 110 (best seen in FIGS. 1 and 2) selectively receiving tube retaining mechanism 106. In the open position illustrated in FIG. 15, actuating lever 126 is visible and the retainers 120 are separated from the retainers 122.

Retainers 122 are shown in a fixed orientation with an edge 264, each of the retainers 122 being affixed to a common retainer carrier 266. Each retainer 122 includes an outer side edge 268 and an inner side edge 270. Outer side edge 268 is spaced laterally inwardly of the side of pump 100. Inner side edge 270 includes a somewhat triangular portion 272 terminating at an apex that is positioned closest to outer side edge 268. Triangular portion 272 is sized to correspond to a wide range of different tubes 116. While a triangular portion 272 is illustrated, other geometries are also envisioned that adequately capture tube 116, grasping the tube so that it can be stretched without subjecting the tube to inappropriately high radially inward compression. Other geometries may include, for example, arcuate portions 272.

Retainers 120 have a corresponding outer side edge 276 with a triangular portion 278 terminating at an apex 280. In the illustrated embodiment both triangular portions are generally identical.

As shown in FIG. 16, with pump 100 in a closed position, retainers 120 have been moved along a generally linear axis R-R generally perpendicular to the axis of tube 116, as noted above, which brings them into selective engagement with retainers 122. In FIG. 16, tube 116 is not present so apexes 274 and 280 are very close to one another and triangular portions 272 and 278 substantially overlap. In practice, the overlap is significantly less when tube 116 is present, and also depends on the size of the tube used.

FIG. 17 is a rear perspective view of retaining mechanism 106 with respect to front cover 108 and without other components such as support structure 104. Retainers 120 are shown to include rear pockets 282 that are offset from each other with respect to axis R-R, but extend parallel to the axis. An integral spring stop 284 of each pocket 282 is fixed. Each pocket 282 is coincident with a corresponding integral spring stop 288 also being fixed. An optional sidewall 286 can be used to provide lateral guidance to the retainers 120. A coil spring 290 is disposed within mating pockets 282, 286 with its free ends in engagement with spring stops 284, 288, respectively, to bias retainer 120 to the closed position. Additional integral stops 289 formed within retainer carrier 266 in some embodiments keep movable retainers 220 from traveling too far outwardly toward fixed retainers 122, spring stops 284 selectively abutting stops 289. Projections 307 are shown extending away from retainers 120 for selective engagement with edges 267 of support structure 104, as discussed below.

Use of pocket 282 and sidewall 286 for each retainer 120 that are offset with respect to axis R-R, permits retainers 120 to move with respect to retainers 122 without interference. It is recognized, however, that if pump 100 is sufficiently large a single spring may be able to be retained within coincidently positioned pockets 282 defined by the two retainers 120, with the spring being trapped between each end 284.

FIG. 17 also shows spring 154 disposed between a bottom edge 294 of front cover 108 and a bottom edge 296 of retaining mechanism 106 located by a spring post 297, retained within mating pockets 298, 300 defined by each component. Spring 154 provides an extension force that biases tube retaining mechanism 106 upwardly with respect to front cover 108 and is retained by posts 160 of the cover from over travel. The top edge of opening 111 may also be used to perform the same function. Since support structure 104 is not illustrated, the retaining mechanism 106 is correctly shown in the figure even though retainers 120,122 are in their closed position. Its normal orientation when pump 100 is closed is shown in FIG. 19, as discussed below.

FIGS. 18 and 19 are front views of pump 100 without front cover 108 or rotor assembly 112, but showing the contribution of support structure 104 to the operation of retaining mechanism 106. In FIG. 18 only a portion of each retainer 120 is shown for clarity. However, retainers 120 are in their open position, spaced away from retainers 122. Each retainer 120 is received within a slot 304, 306 formed in retainer carrier 266. In the open position, portions of retainers 120 overlap. In FIG. 19, the illustrated portions of retainers 120 are in their closed position.

Figure 28:
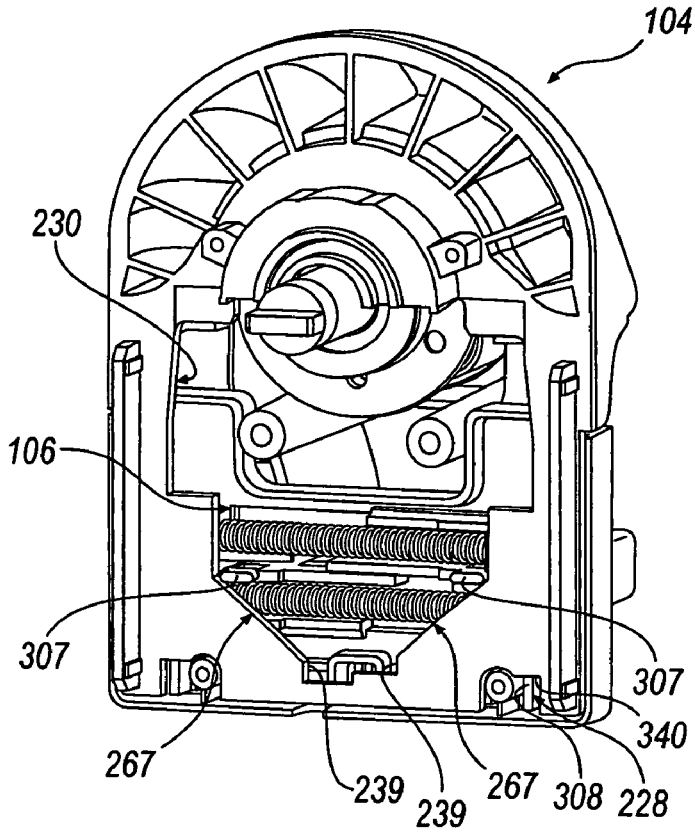
FIG. 28 is a perspective rear view of a portion of the peristaltic pump in the fully closed position.
Figure 29:
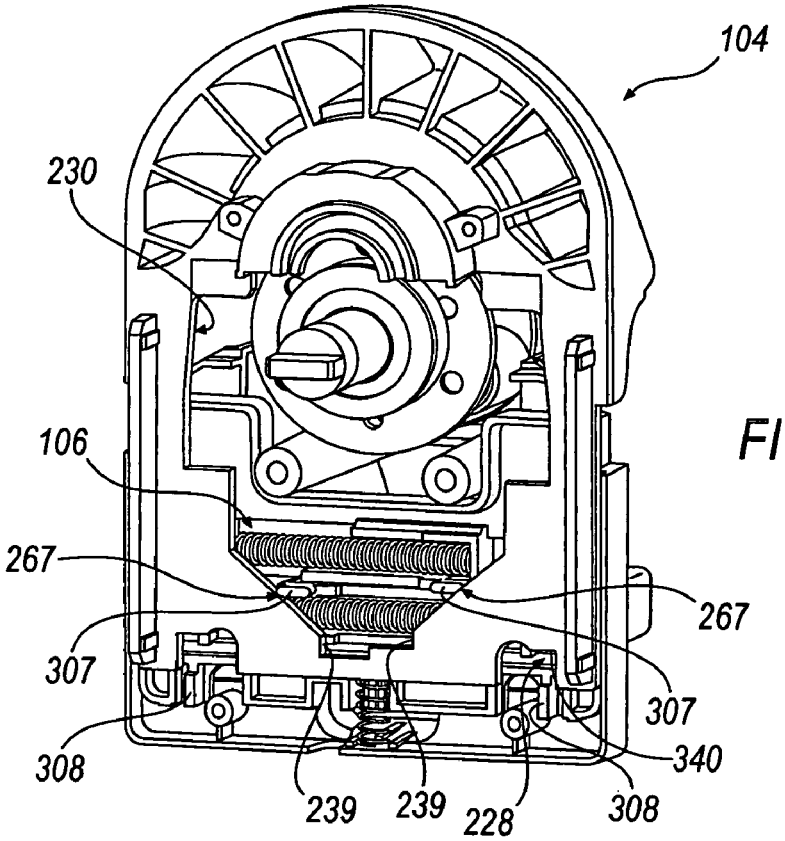
FIG. 29 is a perspective rear view of a portion of the peristaltic pump in the partially open position.
Figure 30:
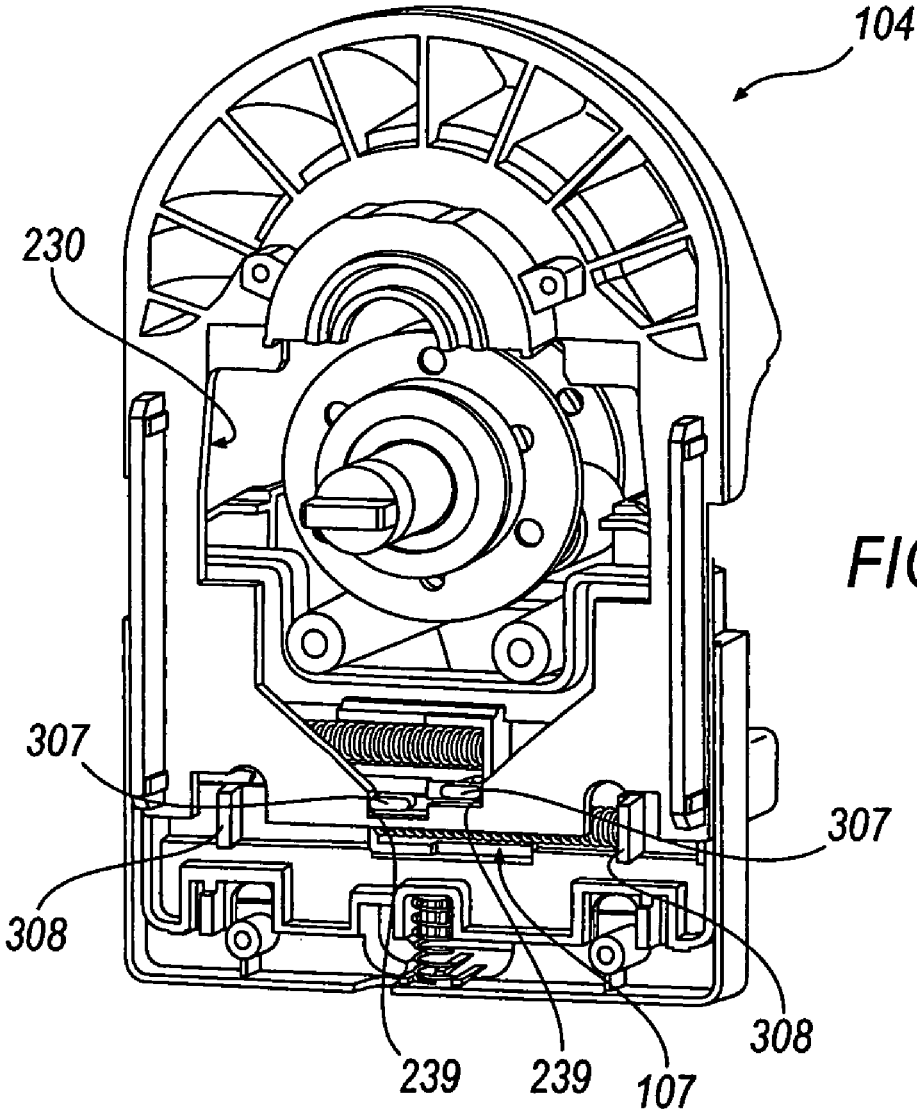
FIG. 30 is a perspective rear view of a portion of the peristaltic pump in the fully open position.

FIGS. 28 through 30 show rear perspective views of a portion of pump 100 and also help illustrate the interaction between support structure 104 and retaining mechanism 106 as the pump moves between the closed and open positions. In FIG. 28 pump 100 is fully closed. FIG. 29 illustrates pump 100 in a partially open position while FIG. 30 shows the pump in the fully open position.

As illustrated, tube retaining mechanism 106 includes one or more projections 308 near its bottom edge received in mating notches 228 extending upwardly from the bottom edge of support structure 104 so that the bottom of the slot is open to permit the selective entering and exiting of projections 308. As a result of the interconnection of the two components, retaining mechanism 106 moves down as support structure 104 also moves down, once an upper edge 340 of each notch 228 engages projections 308.

Thus, as illustrated in FIG. 28 when pump 100 is closed, notches 228 engage projections 308 with retaining mechanism 106 in a fully down position. Thus, projections 307 are essentially no longer in contact with their respective sloped lateral edges 267.

As illustrated in FIGS. 29 and 30, when the vertical force applied by the support structure upon tube retaining mechanism 106 is released by the movement of slots 228 upwardly as pump 100 opens, spring 154 biases tube retaining mechanism 106 upwardly. Projections 307 begin traveling down their respective sloped lateral edges 267, the projections being forced toward one another as they travel down edges 267.

Finally, in FIG. 30, pump 100 is fully open. Retaining mechanism 106 is still fully up. Projections 307 are close to one another having completed their travel down edges 267 and are in contact with vertical edges 239 of opening 230.

Preferably, retainer carrier 266 and retainers 120 are molded in a manner similar to that discussed above with respect to pump body 102, support structure 104, front cover 108, front cap 114, rear cover 124, and mounting plate 132. Retainers 120 and 122 are preferably molded using a glass-filled nylon.

The operation of retaining mechanism 106 is as follows. In FIG. 18, with pump 100 in an open position, retainers 120 are disposed away from retainers 122 against the biasing force of springs 290. Sloped edges 267 of opening 230 of support structure 104 (see, e.g., FIG. 9 where edges 267 are angled) approaching an apex with vertical surfaces 239 toward a bottom edge of the support structure 104 have engaged projections 307 on the rear side of each movable retainer 120, 290, thereby forcing each movable retainer 120 away from mating retainer 122 as support structure 104 is moved upwardly from a closed position to an open position. At the same time, the entire retaining mechanism 106 has also moved upward because of the break in the connection between projections 308 and upper edge 340 of each of the notches 228. In a final locked open position, projections 307 of retaining mechanism 106 (shown in FIG. 18) engage vertical surfaces 239 of support structure 104. In this final position, retainers 120 are maintained in an open position as is working structure 104. Surfaces 239 are normal to the applied force of the springs 290.

After the installation of tube 116, pump 100 is closed. As the pump is closed, working surface 118 of support structure 104 is forced downwardly toward rotor assembly 112. The movement of support structure 104 with its sloped edges 267 permits the gradual de-compression of spring 290, in turn permitting movable retainers 120 to move toward fixed retainers 122 as the opening gets larger. Significantly, the retainers 120 and 122 are self adjusting, and are able to properly restrain any of the tubing sizes for which pump 100 is designed, without requiring any manual adjustments of any aspect of retaining mechanism 106.

After tube 116 is restrained, retaining mechanism 106, by virtue of its connection to support structure 104, is forced downwardly with respect to front cover 108 and pump body 102 as upper edge 340 of each notch 228 engages tabs 308, thereby overcoming and applying a force greater than the tension of spring 154 that biases tube retaining mechanism 106 upward and greater than the resistance of the retained tube 116. The construction of retainer carrier 266 and opening 110 of front cover 108 is such that the tube retaining mechanism 106 may move up and down within the opening without binding and independently of any movement of retainer 120 in the horizontal direction to engage the tubing. The relative movement of retaining mechanism 106 with tube 116 already firmly restrained, is in a direction generally parallel to the axis of the tube as it is positioned between the retaining mechanism 106 and rotor assembly 112. As a result, the tube 116 is stretched, resulting in longer life for the tube. The relative position of the surfaces 294 and 296 (FIG. 17) must be carefully controlled so that when pump 100 is closed they do not interfere with working surface 118 being correctly positioned with respect to rotor assembly 112 by locating features 214 as discussed above. Thus, even when pump 100 is in its closed position, there is at least a slight gap between surfaces 294 and 296.

Linkage Mechanism

Figure 25:
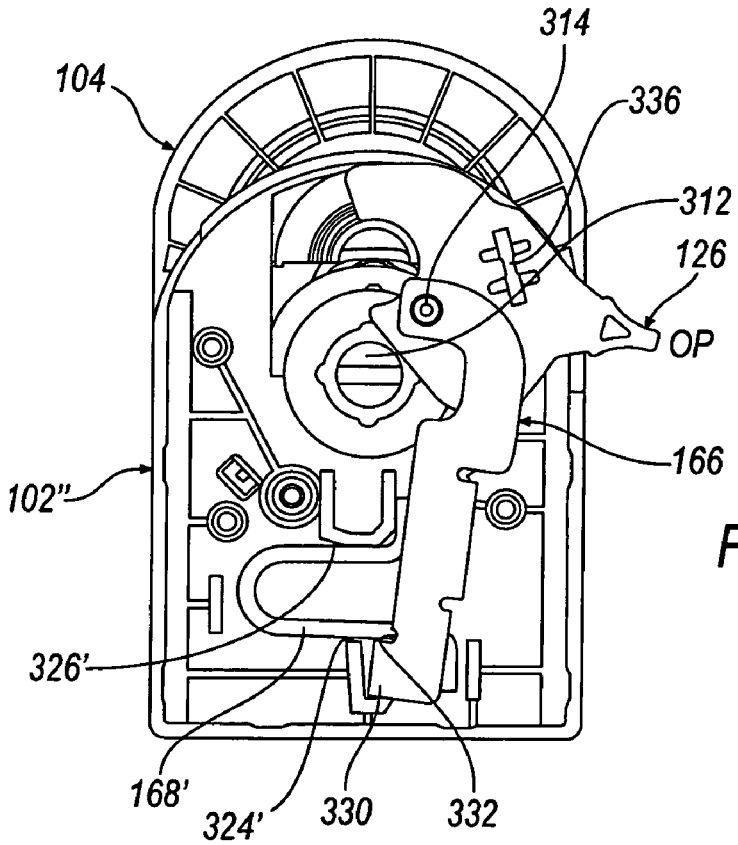
FIG. 25 is a rear view of a portion of the peristaltic pump in an open position and showing aspects of the actuation linkage of the pump in accordance with a second embodiment of the biasing member and a third embodiment of the pump body.
Figure 26:
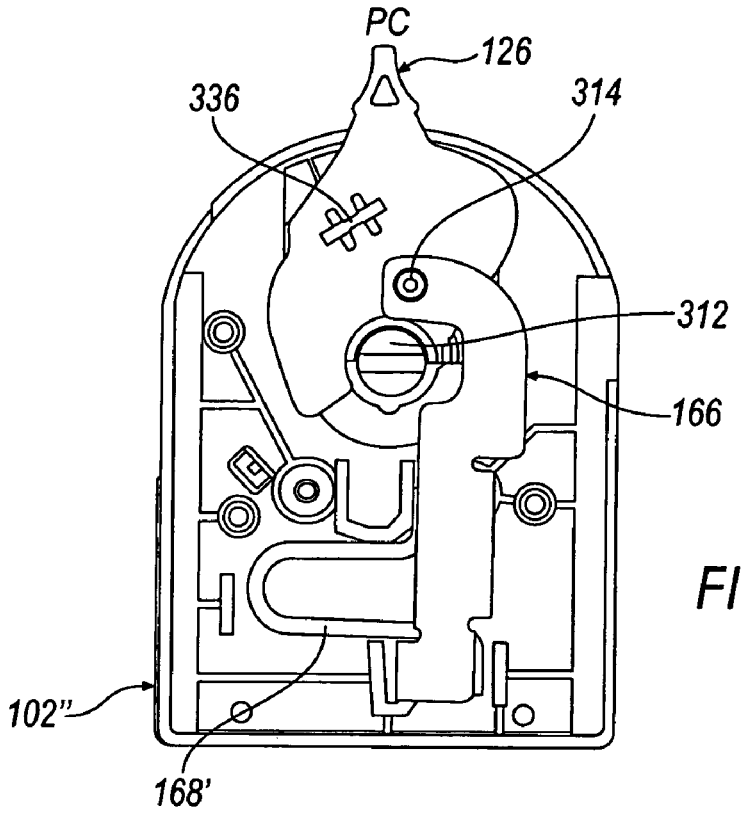
FIG. 26 is a rear view of a portion of the peristaltic pump in partially closed position and showing aspects of the actuation linkage of the pump in accordance with the second embodiment of the biasing member and the third embodiment of the pump body.
Figure 27:
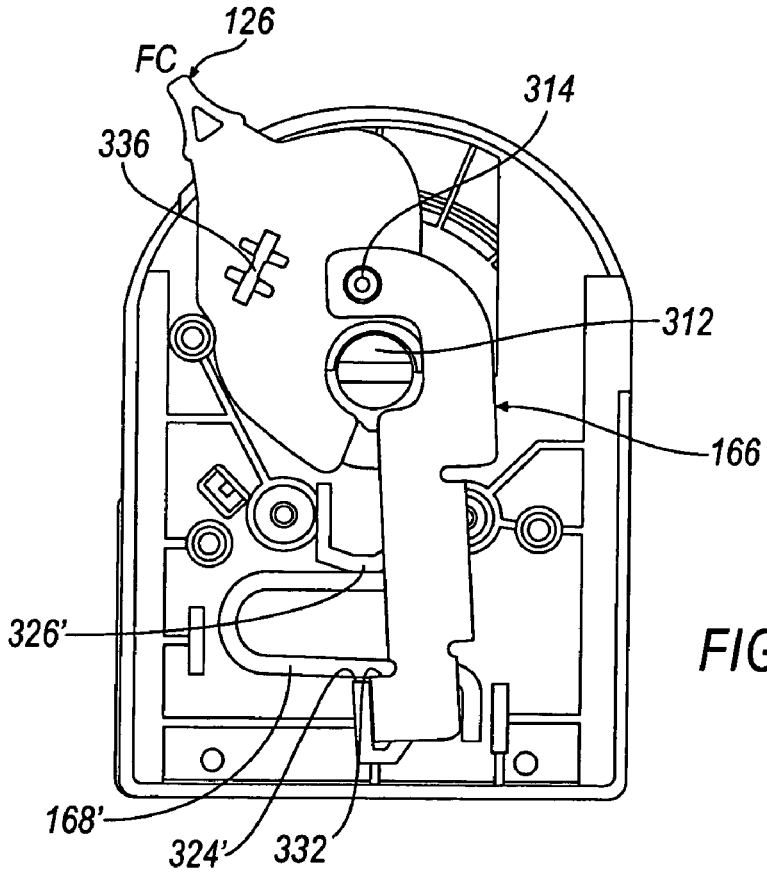
FIG. 27 is a rear view of a portion of the peristaltic pump in a closed position and showing aspects of the actuation linkage of the pump in accordance with the second embodiment of the biasing member and the third embodiment of the pump body.

The opening and closing of peristaltic pump 100 using actuating lever 126 is shown in a first exemplary embodiment in accordance with FIGS. 6, 22, 23 and 24 using a biasing member in the form of coil spring 168. A second exemplary embodiment of peristaltic pump 100 with a different biasing member, a leaf spring, is illustrated in FIGS. 25 through 27. The biasing member can be one of a number of different devices including any type of spring, for example, a coil spring, a c-shaped spring and a leaf spring, and other expandable or compressible tension devices.

Figure 23:
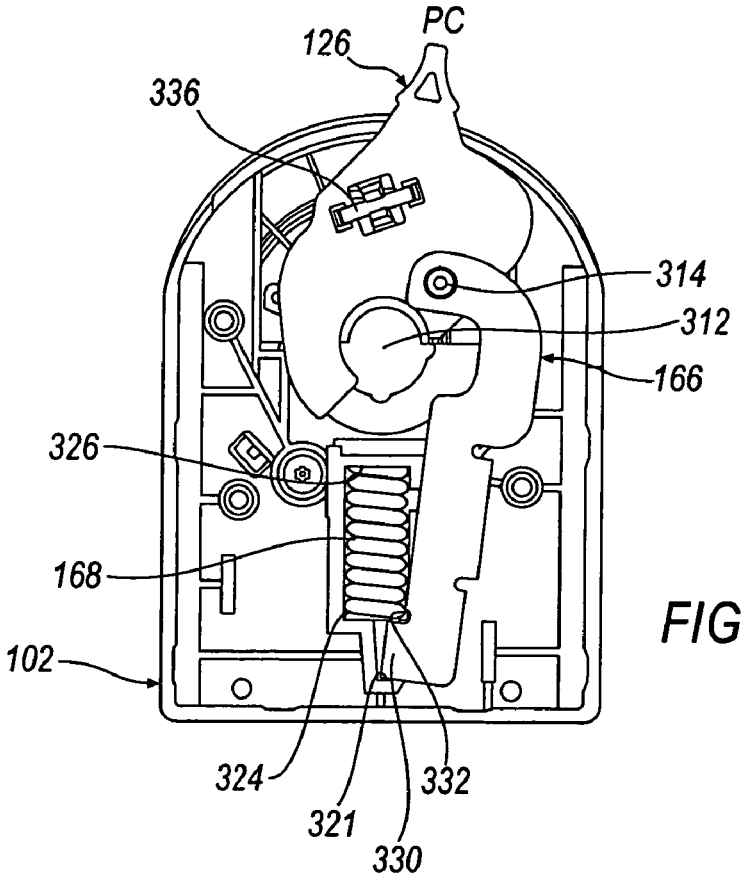
FIG. 23 is a rear view of a portion of the peristaltic pump in a partially closed position and showing aspects of the actuation linkage of the pump in accordance with the first embodiment of the biasing member.

FIGS. 22 and 25 show pump 100 in an open position with an "OP" next to actuating lever 126 while FIGS. 23 and 26 show the pump in a partially closed position with a "PC" next to actuating lever 126. Pump 100 is in a fully closed position in FIGS. 24 and 27, respectively, for the two illustrated embodiments. An "FC" is shown next to actuating lever 126. For the purpose of simplification, rotor assembly 112, rear cover 124 and mounting plate 132 are not shown in FIGS. 22 through 24. Rear cover 124 and mounting plate 132 are also not shown in the embodiment of FIGS. 25 through 27, although rotor assembly 112 is illustrated.

Figure 24:
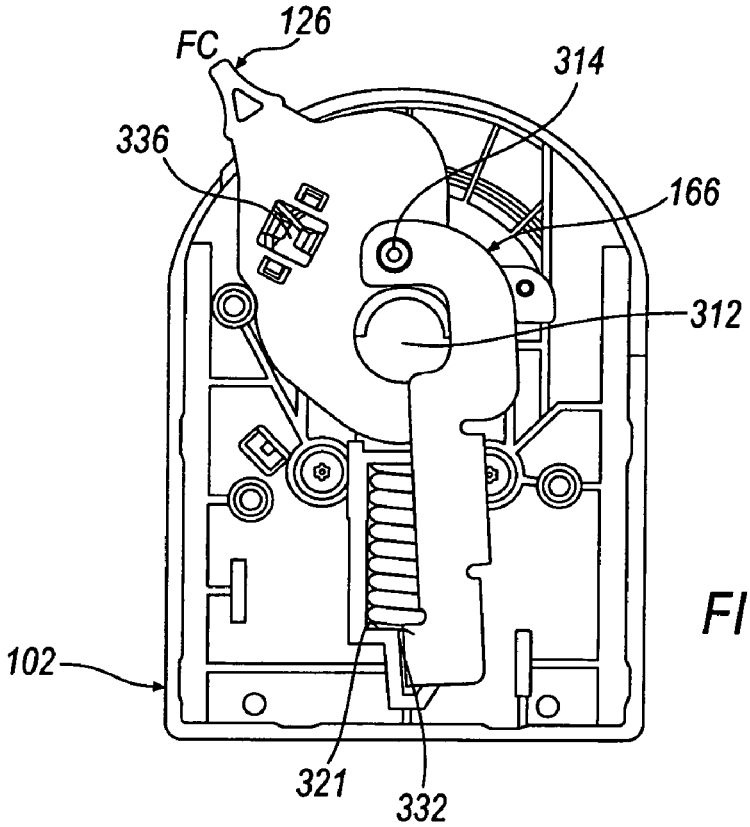
FIG. 24 is a rear view of a portion of the peristaltic pump in closed position and showing aspects of the actuation linkage of the pump in accordance with the first embodiment of the biasing member.

FIGS. 22 through 24 show actuating lever 126 rotatably mounted to arcuate bearing track 246 of support structure 104. Lever 126 includes a mating arcuate surface 310 that permits the lever to be rotated about a first pivot point 312 defined by the center point of bearing track 246. Lever 126 includes a projection that is received in the bearing track 246 in the groove defined by raised areas 247 and 249. Thus, raised arcs 247 and 249 retain lever 126 against opposing forces that are applied as pump 100 is opened and closed. Offset from the first pivot point is a second pivot point defined by a pin 314 passing through mating apertures 316 and 318 of lever 126 and link arm 166, respectively and secured against accidental removal. Alternatively, pin 314 is molded as part of lever 126, and passes through a corresponding aperture of the other component. While under some circumstances it may be possible to mold link arm 166, as a practical matter it is preferably made from a 300 series stainless steel.

An opposite end of link arm 166 also pivots, but with respect to a slot 320 formed in the rear face of pump body 102 adjacent the bottom edge of pump body 102, slot 320 having a pivot surface 321. A pocket 322 for receiving a biasing mechanism in the form of a coil spring 168 is positioned in a vertically abutting relationship with slot 320, but slightly offset. Free ends of spring 168 abut opposing spring stops 324 and 326 of pocket 322 when peristaltic pump 100 is open.

In view of the high stresses placed upon the actuating lever and the likelihood that support structure 104 will be formed from a glass-filled polypropylene, it is generally preferred that lever 126 be formed from a glass and mineral filled Polyphenylene Sulfide ("PPS"). PPS is more expensive, but has high stress tolerance. Further, since lever 126 is in sliding contact with a portion of support structure 104, as discussed, above, using the two dissimilar materials helps to minimize galling.

The linkage mechanism, comprising lever 126, link arm 166, spring 168, and the respective connecting surfaces of both the support structure 104 and pump bed 102, is intended solely to provide an appropriate compressive force. It is not used to locate support structure 104 with respect to pump body 102. The linkage mechanism is non-rigid in the sense that it permits adjustment of the support structure 104 with respect to the pump body 102. As a result, support structure 104 may move laterally or vertically, with respect to pump body 102. Thus, the locating aspect of the support structure 104 with respect to pump body 102 may be implemented without hindrance by the components comprising the linkage mechanism.

When pump 100 is open, as shown in FIG. 22, spring 168 is preloaded against spring stops 324 and 326 with a force of approximately 30 to 110 pounds (134 to 490 Newtons), and preferably about 90 pounds (401 Newtons). The preferred loading has been carefully considered by the inventor. Pump 100 is intended for use with a wide variety of tubes 116. In practice, it is desirable that when pump 100 is closed, the distance between working surface 118 and a roller 170 is less than twice the wall thickness of a tube. It has been found that choosing a preload of approximately 90 pounds (401 Newtons) permits even the tube with the thickest acceptable wall thickness in the most rigid material approved for use to be adequately pinched. On the other hand, exceeding a preload much above 90 pounds (401 Newtons) results in issues with respect to spring construction, placement, and the relative elements of the pump 100 that hold the biasing member.

The range of forces was established by the inventor by simulating the effects of using tube 116 with wall thickness at its extreme upper tolerance limit. He then measured the force required to achieve an acceptable amount of compression.

A primary factor, for controlling the force required, was the formulation (material) of the tube. Thinner wall tube in the same formulation was expected to require less force, but that turned out to not necessarily be true. The lower end of the preferred range provides adequate force for a wide range of tubing sizes and materials. The higher end of the range was intended to address some tubes that have substantially greater force requirements. Moreover, if the force is too high, the tolerances required may not be practical. Moreover, spring 168 itself may become over stressed. Thus, the most preferred force of approximately 90 pounds (401 Newtons) was found best for the widest range and types of tubes that may be desirable to use with pump 100 and taking into account the construction of pump 100 and its associated components.

When pump 100 is opened by moving the actuating lever 126 clockwise, as seen from the back side of the pump, the actuator lever pushes down on the link arm 166, which pushes down against pivot surface 321 of pocket 320 in pump body 102. This action lifts the working surface 118 of support structure 104 vertically away from rotor assembly 112.

When the actuating lever 126 is moved counterclockwise, as seen from the pump back, the direction of forces in the linkage is reversed. The link arm 166 now pulls up against the spring 168. Since the spring 168 has a large preload force, at most it moves only slightly. Instead, the link arm 166 pulls the actuator lever 126 down, which also pulls the working surface 118 of support structure 104 down toward the rotor assembly 112. Retaining mechanism 106, by virtue of its connection to support structure 104, as discussed above, is also moved downwardly. As already noted, the non-rigid nature of the linkage mechanism, permitting both lateral and vertical adjustment, is such that support structure 104 is able to properly position itself with respect to pump body 102 by moving laterally and vertically as necessary so that when the locating features 214 of pump body 102 have engaged the alignment edges of the support structure 104, as discussed above with respect to FIGS. 13 and 14 in particular, the support structure can no longer move, being in a locked closed position.

Then, as the actuation lever 126 is rotated further counterclockwise, the link arm 166 is positioned to pivot within pocket 320 and actually lift spring 168 off spring stop 324 and absorb the full load of the spring. To facilitate the lifting of spring 168, link arm 166 includes a bent tab 330 and a ledge 332 defined by the upper edge of tab 330 Thus, a large force holds support structure 104 against pump body 102 and resists the forces created by the compressing of tube 116 between the rotor rollers 170 and the working surface 118 of the support structure.

An alternative biasing member in the form of a leaf spring 168' is shown in the embodiment of FIGS. 25 through 27. A different pocket with stops 324' and 326' is also illustrated, meaning that pump body 102" is slightly different from pump body 102. The essential operation of leaf spring 168' with link arm 166, however, is very similar to that of the embodiment of FIGS. 22 through 24, including the lifting of an end of spring 168' from spring stop 324' by way of ledge 332 of link arm 166 when the pump is in the closed position as shown in FIG. 27.

In each case, however, the biasing member permits the relative movement of support structure 104 with respect to pump body 102 so that the locating features 214 may be appropriately used as discussed above.

Pump 100 may also include a sensing mechanism for detecting when the pump is open sufficiently to expose moving rotor assembly 112 to finger contact. A magnet 336 is shown attached to actuating lever 126 in FIGS. 22 through 27. A reed switch (not shown) is associated with an adjacent component that provides power, such as a pump motor engaging pump 100. When pump 100 is fully closed, magnet 336 is sufficiently close to the reed switch that the magnetic field produced by the magnet closes the reed switch. As a user operates the actuating lever 126 to open pump 100, the lever moves magnet 336 far enough from the reed switch that the magnetic field experienced by the reed switch is insufficient to keep the reed switch closed. The linkage between actuating lever 126 and the movement of working surface 118 of support structure 104 with respect to rotor assembly 112 is such that the reed switch opens before the support structure 104 has moved a sufficient vertical distance to expose a moving roller 170 to touching by fingers. As a result, when the reed switch opens, a working pump 100 stops and a non-working pump will not start.

CONCLUSION

The above description is intended to be illustrative and not restrictive. Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur and that the disclosed apparatuses, systems and methods will be incorporated into such future embodiments. Accordingly, it will be understood that the invention is capable of modification and variation and is limited only by the following claims.

What is claimed is:

1. A peristaltic pump selectively movable between an open position and a closed position, comprising:

a pump body;

a rotor assembly supported by said pump body; and a support structure having an arcuate working surface confronting said rotor assembly and being movable relative to said pump body, wherein said pump body and said support structure are in a facing relationship with each other, at least one of said pump body and said support structure including locating features each defining a horizontal planar first support surface and the other of said pump body and said support structure including at least one alignment member defining a horizontal planar alignment surface, said at least one alignment member engaging said locating features when said pump is in the closed position so that said support structure is at a fixed location with respect to said pump body when said pump is in the closed position and wherein as said support structure moves with respect to said pump body, said pump moves between said open position and said closed position.

2. A peristaltic pump as recited in claim 1, further comprising a groove with a first width and a first length in one of said pump body and said support structure and a projection on the other of said pump body and said support structure, said projection having a second width and a second length less than said first width and said first length.

3. A peristaltic pump as recited in claim 1, said locating features including said first support surface in a first horizontal direction and a second support surface in a second direction generally perpendicular to said first horizontal direction provided on one of said pump body and said support structure.

4. A peristaltic pump as recited in claim 1, further comprising:

a groove with a first width and a first length in a first direction in one of said pump body and said support structure and a projection on the other of said pump body and said support structure, said projection having a second width and a second length in said first direction less than said first width and said first length;

said locating features including said first support surface in said first horizontal direction and a second support surface in a second direction generally perpendicular to said first direction.

5. A peristaltic pump as recited in claim 1, wherein said support structure is movable in a first direction with respect to said pump body between said open and said closed position, and wherein said pump further includes a tube retaining mechanism, said tube retaining mechanism having a retainer carrier extending in a second direction generally perpendicular to said first direction, said retainer carrier including a fixed pair of retainers and a movable pair of retainers, a biasing mechanism biasing each movable retainer toward a corresponding fixed retainer.

6. A peristaltic pump as recited in claim 5, wherein said support structure includes an opening having a sloped lateral periphery such that said opening approaches an apex toward a lower edge of said support structure, said sloped lateral periphery forcing said movable pair of retainers from said fixed pair of retainers as said support structure moves said pump to said open position and permits the movable pair of retainers to approach said fixed pair of retainers as said support structure moves said pump to said closed position.

7. A peristaltic pump as recited in claim 6, wherein said movable pair of retainers includes a projection, said projection selectively contacting said sloped lateral periphery.

8. A peristaltic pump as recited in claim 7, wherein said tube retaining mechanism moves in said first direction within said opening of said support structure as said support structure moves said pump between said open position and said closed position.

9. A peristaltic pump as recited in claim 8, wherein said tube retaining mechanism is subject to an extension force biasing it away from a lower edge of said pump body.

10. A peristaltic pump as recited in claim 9, wherein said bottom edge of said support structure includes a notch and said retaining mechanism includes a tab, said tab engaging said notch when said pump is in said closed position with a force greater than said tension force.

11. A peristaltic pump as recited in claim 1, said support structure having a bottom edge with a notch, said pump including a tube retaining mechanism, said tube retaining mechanism including a tab, said tab being selectively received in said notch when said pump is in said closed position.

12. A peristaltic pump as recited in claim 1, wherein said support structure includes an opening with a sloped surface, said pump further having a tube retaining mechanism with a movable jaw, said sloped surface forcing said jaw to open as said support structure moves said pump to said open position and said sloped surface permitting said jaw to close as said support structure moves said pump to said closed position.

13. A peristaltic pump as recited in claim 1, said pump further comprising:

a cover such that said support structure is disposed between said pump body and said cover, said cover having an opening; and a tube retaining member, said tube retaining member being disposed between said support structure and said cover, said tube retaining mechanism including a retainer carrier;

wherein said retainer carrier is received within said opening of said cover.

14. A peristaltic pump as recited in claim 13, wherein a biasing mechanism is disposed between said tube retaining member and said cover, said biasing mechanism selectively moving said tube retaining member within said opening of said cover.

15. A peristaltic pump as recited in claim 1, further comprising:

a linkage mechanism including an actuating lever and a link arm, a pivot point permitting said actuating lever to pivot about said link arm; and wherein a first end of said linkage mechanism is selectively connected to said support structure and a second end of said linkage mechanism is selectively connected to said pump body, said pivot point being disposed between said first end and said second end; and wherein when said actuating lever is in a closed position, said linkage mechanism and said locating features lock said support structure to said pump body.

16. A peristaltic pump as recited in claim 15, wherein said support structure includes a bearing track receiving said first end of said linkage mechanism and said pump body includes a pivot surface receiving said second end of said linkage mechanism.

17. A peristaltic pump as recited in claim 16, wherein said actuating lever pivots about said bearing track and said link arm pivots with respect to pivot surface, said pump body including two spring stops, a biasing member selectively engaging each of said spring stops under a pre-load, said link arm lifting said biasing member from one of said spring stops as said actuating lever pivots about said bearing track, from an open position to said closed position.

18. A peristaltic pump as recited in claim 15, said pump body including two spring stops, a biasing member engaging each of said spring stops under a pre-load, said link arm selectively lifting said biasing member from one of said spring stops.

19. A peristaltic pump as recited in claim 17, wherein said pre-load is sufficient to compress a tubing to less than twice its wall thickness when said pump is in the closed position.

20. A peristaltic pump as recited in claim 18, wherein said pre-load is in the range of approximately 30 to 110 pounds (134 to 490 Newtons).

21. A peristaltic pump as recited in claim 19, wherein said pre-load is approximately 90 pounds (401 Newtons).

22. A peristaltic pump as recited in claim 15, wherein said linkage mechanism permits relative movement of said support structure with respect to said pump body.

23. A peristaltic pump as recited in claim 1, wherein:

said locating features selectively limit movement of said support structure along a first axis and a second axis generally perpendicular to said first axis.

a tube retaining mechanism movable along both said first and second axes and selectively restrained by said support structure; and a linkage mechanism including an actuating lever and a link arm, a pivot point permitting said actuating lever to pivot about said link arm;

wherein a first end of said linkage mechanism is selectively connected to said support structure and a second end of said linkage mechanism is selectively connected to said pump body, said pivot point being disposed between said first end and said second end; and wherein when said actuating lever is in a closed position, said linkage mechanism and said locating features lock said support structure to said pump body.

24. A peristaltic pump comprising:

a pump body;

a rotor assembly supported by said pump body; and a support structure movable relative to said pump body, wherein said support structure includes a front face;

an arcuate working surface extending away from said front face and confronting said rotor assembly;

a rear face;

a bearing track extending away from said rear face in a direction opposite said front face, said bearing track including an arcuate surface, a centerpoint of both said arcuate working surface and said bearing track being coincident with one another; and an opening, said opening including sloped lateral edges approaching an apex toward a bottom edge of said support structure.

25. A peristaltic pump as recited in claim 24, said support structure further comprising at least one notch adjacent to said bottom edge.

26. A peristaltic pump as recited in claim 24, said opening further comprising a first edge and a second edge, said first edge being generally perpendicular to said second edge, said sloped lateral edges being spaced away from a point of intersection between said first edge and said second edge.

27. A peristaltic pump as recited in claim 24, a periphery of said opening including a portion of said bearing track.

28. A peristaltic pump as recited in claim 26, said opening further comprising a first edge and a second edge, said first edge being generally perpendicular to said second edge, both said bearing track and said sloped lateral edges being spaced away from a point of intersection between said first edge and said second edge.

29. A peristaltic pump comprising:

a pump body;

a rotor assembly supported by said pump body;

a support structure having an arcuate working surface confronting said rotor assembly and being movable relative to said pump body; and a tube retaining mechanism including a retainer carrier movable in a vertical direction relative to the pump body and having a fixed retainer and a movable retainer each carried by the retainer carrier and movable therewith in the vertical direction relative to the pump body;

selective movement of said movable retainer being determined by selective movement of said support structure relative to said pump body.

30. A peristaltic pump as recited in claim 29, selective movement of said support structure resulting in corresponding movement of said tube retaining mechanism independently of movement of said movable retainer.

31. A peristaltic pump as recited in claim 29 including a biasing mechanism biasing said movable retainer toward said fixed retainer.

32. A peristaltic pump comprising:

a pump body;

a rotor assembly supported by said pump body;

a support structure movable relative to said pump body, wherein said support structure includes a front face;

an arcuate working surface extending away from said front face and confronting said rotor assembly;

a rear face;

a bearing track extending away from said rear face in a direction opposite said front face, said bearing track including an arcuate surface, a centerpoint of both said arcuate working surface and said bearing track being coincident with one another; and an opening, said opening including sloped lateral edges approaching an apex toward a bottom edge of said support structure;

a tube retaining mechanism including a retainer carrier having a fixed retainer and a movable retainer each carried by the retainer carrier;

selective movement of said movable retainer being determined by selective movement of said sloped lateral edges of said support structure; and a linkage mechanism, said linkage mechanism including an actuating lever and a link arm, a pivot point permitting said actuating lever to pivot about said link arm;

wherein a first end of said linkage mechanism is selectively connected to said bearing track and a second end of said linkage mechanism is selectively connected to said pump body, said pivot point being disposed between said first end and said second end; and wherein when said actuating lever is in a closed position, said linkage mechanism locks said support structure to said pump body to lock said pump.

33. A peristaltic pump as recited in claim 32, said pump body including at least one locating member having two surfaces generally perpendicular to each other, said locating member engaging a periphery of said opening of said support structure when said pump is locked.

34. A peristaltic pump as recited in claim 32, further comprising:

a front cover, said support structure being disposed between said pump body and said front cover; and a rotor assembly, said rotor assembly being secured by said front cover and said pump body, wherein said working surface is closer to said rotor assembly when said pump is locked.

* * * * *

UNITED STATES PATENT AND TRADEMARK OFFICE

CERTIFICATE OF CORRECTION

PATENT NO. : 7,478,999 B2
APPLICATION NO. : 11/070989
DATED : January 20, 2009
INVENTOR(S) : Robert F. Limoges It is certified that error appears in the above-identified patent and that said Letters Patent is hereby corrected as shown below:

In column 1, lines 25-26, change "Thus, when power is applied to the motor; the shaft rotates," to --Thus, when power is applied to the motor the shaft rotates,--.

In column 2, line 49, change "the peristaltic pump show in FIG. 1." to --the peristaltic pump shown in FIG. 1.--.

In column 2, line 58, change "pump is an open position." to --pump is in an open position.--.

In column 6, line 8, change "formed in a rear face 211 the front cover 108" to --formed in a rear face 211 of the front cover 108--.

In column 6, line 15, change "many other mechanism can be used" to --many other mechanisms can be used--.

In column 6, line 30, change "FIG. 7, in combination with FIG. 6, illustrate" to --FIG. 7, in combination with FIG. 6, illustrates--.

In column 6, line 56, change "(See FIG. 8) and 196 (See FIG. 17)" to --(see FIG. 8) and 196 (see FIG. 17)--.

In column 8, lines 27-28, change "are selectively received within locating grooves 212 (as seen in FIG. 8) extend away" to --are selectively received within locating grooves 212 (as seen in FIG. 8) and extend away--.

In column 9, lines 2-3, change "for illustration, only." to --for illustration only.--.

In column 11, lines 7-8, change "for each retainer 120 that are offset" to --for each retainer 120 that is offset--.

In column 13, lines 52-53, change "as discussed, above," to --as discussed above,--.

In column 14, line 66, change "edge of tab 330 Thus," to --edge of tab 330. Thus,--.

Signed and Sealed this

Second Day of March, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,478,999 B2
APPLICATION NO. : 11/070989
DATED : January 20, 2009
INVENTOR(S) : Robert F. Limoges It is certified that error appears in the above-identified patent and that said Letters Patent is hereby corrected as shown below:

In column 1, lines 25-26, change "Thus, when power is applied to the motor; the shaft rotates," to --Thus, when power is applied to the motor the shaft rotates,--.

In column 2, line 49, change "the peristaltic pump show in FIG. 1." to --the peristaltic pump shown in FIG. 1.--.

In column 2, line 58, change "pump is an open position." to --pump is in an open position.--.

In column 6, line 8, change "formed in a rear face 211 the front cover 108" to --formed in a rear face 211 of the front cover 108--.

In column 6, line 15, change "many other mechanism can be used" to --many other mechanisms can be used--.

In column 6, line 30, change "FIG. 7, in combination with FIG. 6, illustrate" to --FIG. 7, in combination with FIG. 6, illustrates--.

In column 6, line 56, change "(See FIG. 8) and 196 (See FIG. 17)" to --(see FIG. 8) and 196 (see FIG. 17)--.

In column 8, lines 27-28, change "are selectively received within locating grooves 212 (as seen in FIG. 8) extend away" to --are selectively received within locating grooves 212 (as seen in FIG. 8) and extend away--.

In column 9, lines 2-3, change "for illustration, only." to --for illustration only.--.

This certificate supersedes the Certificate of Correction issued March 2, 2010.

Signed and Sealed this

Second Day of November, 2010

David J. Kappos

David J. Kappos
*Director of the United States Patent and Trademark Office*

In column 11, lines 7-8, change “for each retainer 120 that are offset” to --for each retainer 120 that is offset--.

In column 13, lines 52-53, change “as discussed, above,” to --as discussed above,--.

In column 14, line 66, change “edge of tab 330 Thus,” to --edge of tab 330. Thus,--.

In claim 23, column 18, line 9, change “generally perpendicular to said first axis.” to --generally perpendicular to said first axis;--.